US009248638B2

(12) United States Patent
Yogosawa et al.

(10) Patent No.: US 9,248,638 B2
(45) Date of Patent: Feb. 2, 2016

(54) CLEANING DEVICE AND IMAGE FORMING APPARATUS INCORPORATING SAME

(71) Applicants: Kazuki Yogosawa, Tokyo (JP); Kenji Sugiura, Kanagawa (JP); Naohiro Kumagai, Kanagawa (JP); Seiichi Kogure, Kanagawa (JP); Junpei Fujita, Kanagawa (JP); Yuuji Wada, Kanagawa (JP); Yusuke Mitani, Kanagawa (JP)

(72) Inventors: Kazuki Yogosawa, Tokyo (JP); Kenji Sugiura, Kanagawa (JP); Naohiro Kumagai, Kanagawa (JP); Seiichi Kogure, Kanagawa (JP); Junpei Fujita, Kanagawa (JP); Yuuji Wada, Kanagawa (JP); Yusuke Mitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/602,462

(22) Filed: Jan. 22, 2015

(65) Prior Publication Data

US 2015/0205248 A1 Jul. 23, 2015

(30) Foreign Application Priority Data

Jan. 23, 2014 (JP) ..... 2014-010086
Jun. 30, 2014 (JP) ..... 2014-133543

(51) Int. Cl.
*G03G 21/00* (2006.01)
*B41F 23/00* (2006.01)
*G03G 21/16* (2006.01)

(52) U.S. Cl.
CPC ..... *B41F 23/002* (2013.01); *G03G 21/169* (2013.01); *G03G 2221/1618* (2013.01)

(58) Field of Classification Search
CPC . G03G 15/161; G03G 15/166; G03G 15/168; G03G 21/169; G03G 21/0076; G03G 2215/1661; G03G 2221/001; G03G 2221/1618; B41F 23/002
USPC ..... 399/101, 123, 349
See application file for complete search history.

(56) References Cited

U.S. PATENT DOCUMENTS

| | | | | |
|---|---|---|---|---|
| 5,444,522 | A * | 8/1995 | Owens, Jr. | 399/123 |
| 8,682,208 | B2 * | 3/2014 | Asaoka et al. | 399/101 |
| 8,965,240 | B2 * | 2/2015 | Yonemoto | 399/101 |
| 2009/0196648 | A1 * | 8/2009 | Inoue | 399/101 |
| 2012/0034006 | A1 | 2/2012 | Asaoka et al. | |
| 2013/0315617 | A1 | 11/2013 | Sugiura et al. | |

(Continued)

FOREIGN PATENT DOCUMENTS

| | | | |
|---|---|---|---|
| JP | 61107371 | A * | 5/1986 |
| JP | 2001-225985 | | 8/2001 |

(Continued)

*Primary Examiner* — Robert Beatty
(74) *Attorney, Agent, or Firm* — Oblon, McClelland, Maier & Neustadt, L.L.P.

(57) ABSTRACT

A cleaning device includes a cleaner, a plurality of cleaning sub-units, a sub-unit holder, a detachable transmission assembly, and a plurality of joint couplers. The cleaner scrapes off adhered material from a surface of a cleaning target while contacting the surface of the cleaning target. The cleaning sub-units each includes a holder to hold the cleaner and a drive-receive rotator to receive a driving force. The sub-unit holder holds the cleaning sub-units. The detachable transmission assembly includes a driving-force receive rotator to receive a driving force from an external unit and a plurality of drive transmission rotators to transmit the driving force received by the driving-force receive rotator to the drive-receive rotators of the cleaning sub-units. The joint couplers mounted on the drive-receive rotators and the drive transmission rotators couple the drive-receive rotators with the drive transmission rotators in a rotation axial direction.

8 Claims, 14 Drawing Sheets

(56) References Cited

U.S. PATENT DOCUMENTS

| | | | |
|---|---|---|---|
| 2014/0064769 | A1 | 3/2014 | Sugiura |
| 2014/0321874 | A1 | 10/2014 | Sugiura et al. |

FOREIGN PATENT DOCUMENTS

| | | |
|---|---|---|
| JP | 2012-037744 | 2/2012 |
| JP | 2013-054170 | 3/2013 |

* cited by examiner

CLEANING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2014-010086, filed on Jan. 23, 2014 and 2014-133543, filed on Jun. 30, 2014 in the Japan Patent Office, the entire disclosure of each of which is hereby incorporated by reference herein.

BACKGROUND

1. Technical Field

Embodiments of this disclosure relate to a cleaning device including multiple cleaning members to scrape off adhered substance on a surface of a cleaning target and an image forming apparatus employing the cleaning device to remove toner on a surface of an image bearer.

2. Description of the Related Art

Image forming apparatuses are used as, for example, copiers, printers, facsimile machines, and multi-functional devices having at least one of the foregoing capabilities. Such an image forming apparatus may include an image bearer to bear a toner image on a surface thereof and a cleaning device to remove adhered substance, e.g., toner particles from the surface of the image bearer.

For example, as illustrated in FIG. 20, an image forming apparatus includes a cleaning device 900 and an intermediate transfer belt 908 serving as an image bearer. In FIG. 20, the cleaning device 900 includes a first sub unit 901, a second sub unit 911, a third sub unit 921, and a sub-unit holder 950 to hold the first sub unit 901, the second sub unit 911, and the third sub unit 921, respectively. The first sub unit 901, the second sub unit 911, and the third sub unit 921 hold multiple members including, e.g., a cleaning brush roller 902, a cleaning brush roller 912, and a cleaning brush roller 922 with a sub-unit casing 906, a sub-unit casing 916, and a sub-unit casing 926, respectively.

The sub-unit holder 950 has a first support 951 to support the first sub unit 901 in such a manner that the first sub unit 901 is slidable in a longitudinal direction thereof (a direction perpendicular to a sheet surface on which FIG. 20 is printed). The sub-unit holder 950 also has a second support 952 to support the second sub unit 911 in such a manner that the second sub unit 911 is slidable in a longitudinal direction thereof and a third support 953 to support the third sub unit 921 in such a manner that the third sub unit 921 is slidable in a longitudinal direction thereof. With such sliding movement, the first sub unit 901, the second sub unit 911, and the third sub unit 921 are removably mountable relative to the sub-unit holder 950.

For such a configuration, when one of the cleaning brush roller 902, the cleaning brush roller 912, and the cleaning brush roller 922 comes to the end of product life, a user can replace only one of the multiple sub cleaning units including the cleaning brush roller having come to the end of product life with a new one and continue to use the other sub cleaning units remaining in the cleaning device 900. Such a configuration can reduce servicing cost of the cleaning device as compared with a configuration in which a single holder holds multiples components.

SUMMARY

In at least one aspect of this disclosure, there is provided an improved cleaning device including a cleaner, a plurality of cleaning sub-units, a sub-unit holder, a detachable transmission assembly, and a plurality of joint couplers. The cleaner scrapes off adhered material from a surface of a cleaning target while contacting the surface of the cleaning target. The plurality of cleaning sub-units each includes a holder to hold the cleaner and a drive-receive rotator to receive a driving force. The sub-unit holder holds the plurality of cleaning sub-units. The detachable transmission assembly includes a driving-force receive rotator to receive a driving force from an external unit and a plurality of drive transmission rotators to transmit the driving force received by the driving-force receive rotator to the drive-receive rotators of the plurality of cleaning sub-units. The plurality of joint couplers mounted on the drive-receive rotators and the plurality of drive transmission rotators couple the drive-receive rotators with the plurality of drive transmission rotators in a rotation axial direction.

In at least one aspect of this disclosure, there is provided an improved image forming apparatus including an image bearer, an image forming device, and a cleaning device. The cleaning device includes a cleaner, a plurality of cleaning sub-units, a sub-unit holder, a detachable transmission assembly, and a plurality of joint couplers. The cleaner scrapes off toner as adhered substance from the surface of the image bearer. The plurality of cleaning sub-units each includes a holder to hold the cleaner and a drive-receive rotator to receive a driving force. The sub-unit holder holds the plurality of cleaning sub-units. The detachable transmission assembly includes a driving-force receive rotator to receive a driving force from an external unit and a plurality of drive transmission rotators to transmit the driving force received by the driving-force receive rotator to the drive-receive rotators of the plurality of cleaning sub-units. The plurality of joint couplers mounted on the drive-receive rotators and the plurality of drive transmission rotators couples the drive-receive rotators with the plurality of drive transmission rotators in a rotation axial direction.

In at least one aspect of this disclosure, there is provided an improved unit device detachably attachable relative to a machine body. The device includes a plurality of sub units, a sub-unit holder, a plurality of cleaning sub-units, a sub-unit holder, a detachable transmission assembly, and a plurality of joint couplers. The plurality of sub units each includes a driver to be driven by a driving force. The sub-unit holder holds the plurality of sub-units. The plurality of cleaning sub-units each includes a holder to hold the cleaner and a drive-receive rotator to receive a driving force. The sub-unit holder holds the plurality of cleaning sub-units. The detachable transmission assembly includes a driving-force receive rotator to receive a driving force from an external unit and a plurality of drive transmission rotators to transmit the driving force received by the driving-force receive rotator to the drive-receive rotators of the plurality of cleaning sub-units. The plurality of joint couplers mounted on the drive-receive rotators and the plurality of drive transmission rotators couple the drive-receive rotators with the plurality of drive transmission rotators in a rotation axial direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
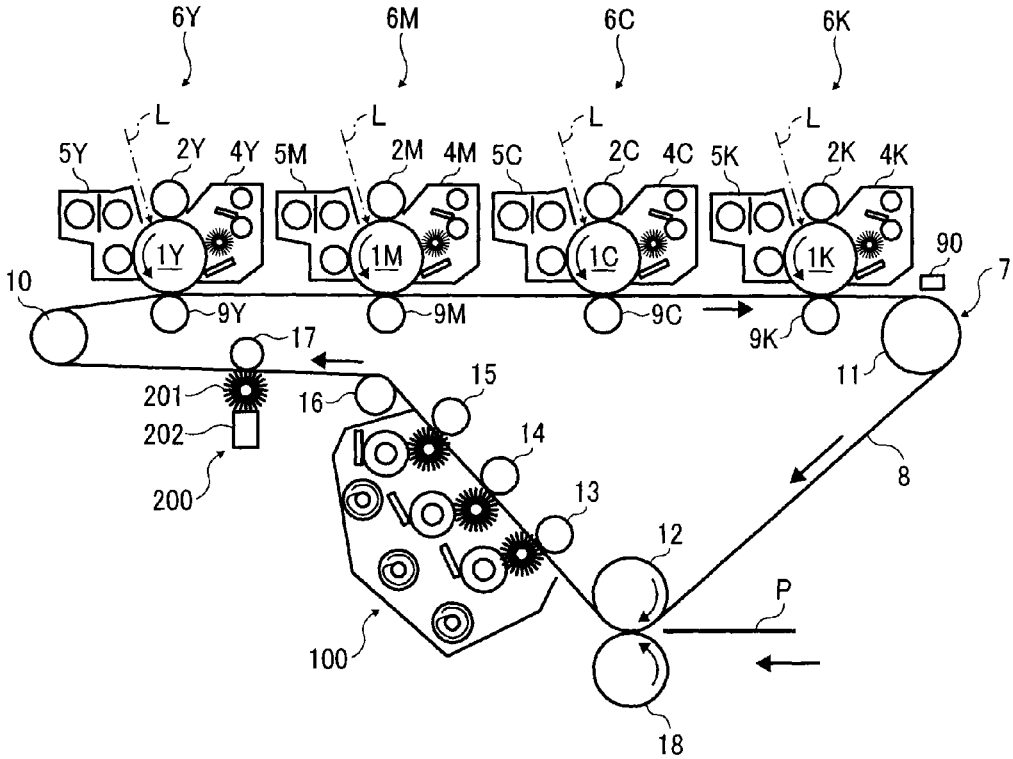
FIG. 1 is a schematic view of a configuration of a part of an image forming apparatus according to at least one embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

As an image forming apparatus according to an embodiment of this disclosure, a tandem-type printer of an intermediate transfer system (to be simply referred to as a printer hereinafter) is described below. However, the image forming apparatus is not limited to the tandem-type printer of an intermediate transfer system and may be any other suitable type of image forming apparatus. First, a basic configuration of the image forming apparatus according to this embodiment is described below. FIG. 1 is a schematic view of a configuration of a part of the image forming apparatus according to this embodiment. The printer includes four process units 6Y, 6M, 6C, and 6K to form toner images in yellow, magenta, cyan, and black (hereinafter referred to as Y, M, C, and K). The four process units 6Y, 6M, 6C, and 6K have drum-shaped photoconductors 1Y, 1M, 1C, and 1K, respectively. The photoconductors 1Y, 1M, 1C, and 1K have charging devices 2Y, 2M, 2C, and 2K, developing devices 5Y, 5M, 5C, and 5K, drum cleaning devices 4Y, 4M, 4C, and 4K, neutralizing devices, and the like therearound, respectively. The process units 6Y, 6M, 6C, and 6K use Y, M, C, and K toners having colors different from each other, but have the same configurations, respectively. Above the process units 6Y, 6M, 6C, and 6K is disposed an optical writing unit to irradiate a laser beam L on surfaces of the photoconductors 1Y, 1M, 1C, and 1K to write electrostatic latent images.

Below the process units 6Y, 6M, 6C, and 6K is disposed a transfer unit 7 including an endless intermediate transfer belt 8 serving as an image bearer. In addition to the intermediate transfer belt 8, the transfer unit 7 includes, e.g., a plurality of extension rollers disposed inside a loop of the intermediate transfer belt 8, a secondary transfer roller 18 disposed outside the loop, a tension roller 16, a belt cleaning device 100, and a lubricant application device 200.

Inside the loop of the intermediate transfer belt 8, four primary transfer rollers 9Y, 9M, 9C, and 9K, a driven roller 10, a driving roller 11, a secondary-transfer opposed roller 12, three cleaning opposed rollers 13, 14, and 15, and an applying brush opposed roller 17 are disposed. Each of all the rollers functions as an extension roller having a peripheral surface on which the intermediate transfer belt 8 is partially hung to extend the belt. As a necessary condition of the cleaning opposed rollers 13, 14, and 15, the cleaning opposed rollers 13, 14, and 15 need not necessarily give a predetermined tension to the belt. The cleaning opposed rollers 13, 14, and 15 may be driven and rotated with the rotation of the intermediate transfer belt 8. The intermediate transfer belt 8 is endlessly moved in the counterclockwise direction in FIG. 1 with the rotation of the driving roller 11 rotationally driven in the counterclockwise direction in FIG. 1 by a driving unit.

The four primary transfer rollers 9Y, 9M, 9C, and 9K disposed inside the belt loop sandwich the intermediate transfer belt 8 between the primary transfer rollers 9Y, 9M, 9C, and 9K and the photoconductors 1Y, 1M, 1C, and 1K, respectively. In this manner, primary transfer nips for Y, M, C, and K on which the front surface of the intermediate transfer belt 8 is brought into contact with the photoconductors 1Y, 1M, 1C, and 1K are formed. Primary transfer biases each having a polarity opposite that of toner are applied to the primary transfer rollers 9Y, 9M, 9C, and 9K with power supplies, respectively.

The secondary-transfer opposed roller 12 disposed inside the belt loop sandwiches the intermediate transfer belt 8 between the secondary-transfer opposed roller 12 and a secondary transfer roller 18 disposed outside the belt loop. In this manner, a secondary transfer nip on which the front surface of the intermediate transfer belt 8 is brought into contact with the secondary transfer roller 18 is formed. A secondary transfer bias having a polarity opposite that of toner is applied to the secondary transfer roller 18 with a power supply. A sheet conveyance belt may be bridged by a secondary transfer roller, several support rollers, and a driving roller, and the intermediate transfer belt 8 and the sheet conveyance belt may be sandwiched between the secondary transfer roller 18 and the secondary-transfer opposed roller 12.

The three cleaning opposed rollers 13, 14, and 15 disposed inside the belt loop sandwich the intermediate transfer belt 8 between the cleaning opposed rollers 13, 14, and 15 and three cleaning brush rollers of a belt cleaning device 100 disposed outside the belt loop. In this manner, a cleaning nip on which the front surface of the intermediate transfer belt 8 is brought into contact with the three cleaning brush rollers is formed. The belt cleaning device 100 is replaceable together with the transfer unit 7. The belt cleaning device 100 is also removable from the transfer unit 7 having removed from an apparatus body of the image forming apparatus. Furthermore, with the transfer unit 7 and the belt cleaning device 100 mounted in the apparatus body, a sub cleaning unit is removably mountable relative to the belt cleaning device 100. The belt cleaning device 100 will be described in detail below.

The image forming apparatus according to this embodiment includes a sheet feed section having a sheet feed tray to store a recording sheet P, a sheet feed roller that feeds the recording sheet P from the sheet feed tray to a sheet feed path. A pair of registration rollers to receive the recording sheet P sent from the sheet feed section and sends the recording sheet P toward the secondary transfer nip at a proper timing is disposed on the right side of the secondary transfer nip in FIG. 1. A fixing device is disposed on the left of the secondary transfer nip in FIG. 1. The fixing device receives the recording sheet P sent from the secondary transfer nip and performs a fixing process of a toner image on the recording sheet P. As needed, toner supply devices for Y, M, C, and K that supply Y, M, C, and K toners to the development devices 5Y, 5M, 5C, and 5K are also disposed.

In recent years, the frequency of use of, in addition to a plain sheet that has been conventionally and widely used as a recording sheet, a special sheet designed to have uneven surfaces or a special recording sheet used for thermal transfer such as ironing print has been increased. When the special sheet is used, in comparison with in use of a conventional regular sheet, defective transfer is likely to occur when a toner image on the intermediate transfer belt 8 obtained by overlapping color toner images is secondarily transferred onto a sheet. Hence, in the image forming apparatus, an elastic layer having low hardness is formed on the intermediate transfer belt 8, so that the intermediate transfer belt 8 can be transformed for the toner layer or a recording sheet having poor smoothness at the transfer nipping portion. The elastic layer having low hardness is formed on the intermediate transfer belt 8 to make the intermediate transfer belt 8 elastic, so that the surface of the intermediate transfer belt 8 can be transformed in accordance with local irregularity. In this manner, good tightness can be achieved without excessively increasing a transfer pressure on the toner layer, character missing in transfer does not occur, and a uniform transferred image in which uneven transfer does not occur on a sheet or the like having poor smoothness can be obtained.

In the image forming apparatus, the intermediate transfer belt 8 includes at least a base layer, an elastic layer, and a coat layer serving as the uppermost layer.

As a material used in the elastic layer of the intermediate transfer belt 8, an elastic member such as an elastic material rubber or an elastomer is given. More specifically, one or more selected from the group consisting of isobutylene-isoprene rubber, fluororubber, acrylic rubber, ethylene propylene diene monomer (EPDM), nitrile rubber (NBR), acrylonitrile-butadiene-styrene rubber, natural rubber, isoprene rubber, styrene-butadiene rubber, butadiene rubber, polyurethane rubber, syndiotactic 1,2-polybutadiene, epichlorohydrin rubber, polysulfide rubber, polynorbornene rubber, and thermoplastic elastomer (for example, polystyrene resin, polyolefin resin, polyvinyl chloride resin, polyurethane resin, polyamide resin, polyurea resin, polyester resin, and fluorine resin) can be used. However, the material used in the elastic layer is not limited to the above materials.

The thickness of the elastic layer, depending on a hardness and a layer configuration, preferably ranges from 0.07 mm to 0.5 mm. More preferably, the thickness ranges from 0.25 mm to 0.5 mm. When the thickness of the intermediate transfer belt 8 is small, i.e., 0.07 mm or less, a pressure on toner on the intermediate transfer belt 8 at the secondary transfer nip becomes high, character missing in transfer is likely to occur, and a transfer ratio of toner decreases.

The hardness of the elastic layer preferably falls within a range given by $10° \leq HS \leq 65°$ (JIS-A). Although an optimum hardness changes depending on the layer thickness of the intermediate transfer belt 8, when the hardness is lower than 10° (JIS-A), character missing in transfer is likely to occur. By contrast, when the hardness is higher than 65° (JIS-A), the intermediate transfer belt 8 is difficult to stretch between the rollers, and the intermediate transfer belt 8 extends due to long-term stretching to lose the durability. As a result, the intermediate transfer belt 8 need to be early exchanged.

The base layer of the intermediate transfer belt 8 is made of a resin having low elongation. More specifically, as a material used in a base layer, one or more selected from a group consisting of styrene resin (single polymer including styrene or a styrene substitute or copolymer) such as polycarbonate, fluoro resin (ethylene tetrafluoroethylene (ETFE), polyvinylidene difluoride (PVDF), or the like), polystyrene, chloropolystyrene, poly-α-methyl styrene, styrene-butadiene copolymer, styrene-vinyl chloride copolymer, styrene-vinyl acetate copolymer, styrene-maleic acid copolymer, styrene-acrylic ester copolymer (styrene-acrylic acid methyl copolymer, styrene-acrylic acid ethyl copolymer, styrene-acrylic acid butyl copolymer, styrene-acrylic acid octyl copolymer, styrene-acrylic acid phenyl copolymer, or the like), styrene-methacrylic acid ester copolymer (styrene-methyl methacrylate copolymer, styrene-methacrylic acid ethyl copolymer, styrene-methacrylic acid phenyl copolymer, or the like), styrene-α-chloracrylic acid methyl copolymer, styrene-acrylonitrile-acrylic ester copolymer, methyl methacrylate resin, methacrylate butyl resin, acrylic acid ethyl resin, acrylic acid butyl resin, denaturing acrylic acid resin (silicone denaturation acrylic acid resin, vinyl chloride resin denaturation acrylic acid resin, acrylic urethane resin, or the like), vinyl chloride resin, styrene-vinyl acetate copolymer, vinyl chloride-vinyl acetate copolymer, rosin-modified maleic acid resin, phenolic resin, epoxy resin, polyester resin, polyester polyurethane resin, polyethylene, polypropylene, polybutadiene, polyvinylidene chloride, an ionomer resin, polyurethane resin, silicone resin, ketone resin, ethylene-ethyl acrylate copolymer, xylene resin and polyvinyl butyral resin, polyamide resin, modified polyphenylene oxide resin, and the like can be used. However, the material used in the elastic layer is not limited to the above materials.

In order to prevent elongation of the elastic layer made of a rubber material or the like having high elongation, a core layer made of a material such as canvas or the like may be disposed between the base layer and the elastic layer. As a material that is used in the core layer to prevent elongation of the core layer, for example, one or more selected from the group consisting of a natural fiber such cotton or silk, a synthetic fiber such as a polyester fiber, a nylon fiber, an acrylic fiber, a polyolefin fiber, a polyvinyl alcohol fiber, a polychlorinated vinyl fiber, a polyvinylidene chloride fiber, a polyurethane fiber, a polyacetal fiber, a polyphloroethylene fiber, or a phenol fiber, an inorganic fiber such as a carbon fiber or a glass fiber, and a metal fiber such as an iron fiber or a copper fiber are used, and a fiber in the form of a thread or a woven cloth can be used. However, the material to prevent the elongation is not limited to the above materials. The thread may be one filament or obtained by twisting a plurality of filaments. A thread such as a single twist yarn, a plied yarn, or a two folded yarn that is twisted by any twisting method may be used. Fibers of materials selected from the material group described above may be blended. As a matter of course, a thread applied with an appropriate process to have electrical conductivity may be used. On the other hand, as a woven fabric, a woven fabric such as a knitted fabric that is woven by any weave can be used. A woven fabric obtained by combined weaving can also be used, and can also be applied with a process to have electrical conductivity.

The coat layer on the surface of the intermediate transfer belt 8 coats the surface of the elastic layer, and is constituted of a smooth layer. A material used in the coat layer is not limited to a specific one. However, in general, a material that reduces adherence of toner to the surface of the intermediate transfer belt 8 to improve secondary transfer properties is used. For example, particles made of one or more of polyurethane, polyester, an epoxy resin, and the like or one or more of materials that reduce surface energy to improve lubricity, for example, a fluorocarbon resin, a fluorine compound, fluorocarbon, a titanium oxide, and a silicon carbide can be used such that the particles are dispersed while being reduced in diameter as needed. A material such as a fluorine rubber material that is applied with thermal treatment to form a fluorine layer on the surface and to decrease surface energy can also be used.

As needed, as a base layer, an elastic layer, or a coat layer, in order to adjust the resistance, for example, metal powder of carbon black, graphite, aluminum, or nickel or a conductive metal oxide such as tin oxide, titanium oxide, antimony oxide, indium oxide, potassium titanate, antimony oxide-tin oxide complex oxide (ATO), indium oxide-tin oxide complex oxide (ITO), or the like can be used. In this case, the conductive metal oxide may be obtained by covering insulating fine particles of barium sulfate, magnesium silicate, calcium carbonate, or the like with a conductive metal oxide. However, the material used in the elastic layer is not limited to the above materials.

A lubricant is applied to the surface of the intermediate transfer belt 8 by a lubricant application device 200 to protect the belt surface. The lubricant application device 200 includes a solid lubricant 202 such as zinc stearate agglomerate and an application brush roller 201 serving as an application member that is brought into contact with the solid lubricant to apply lubricant powder obtained by scraping the solid lubricant with rotation to the surface of the intermediate transfer belt 8. The image forming apparatus includes the lubricant application device 200. However, depending on toner to be applied and the material and the surface friction coefficient of the intermediate transfer belt 8, the lubricant application device 200 need not be always included, and lubricant need not be necessarily applied.

When image information is sent from a personal computer or the like, the printer rotationally drives the driving roller 11 to endlessly move the intermediate transfer belt 8. Extension rollers except for the driving roller 11 are rotated by following the belt. At the same time, the photoconductors 1Y, 1M, 1C, and 1K of the process units 6Y, 6M, 6C, and 6K are rotationally driven. While the surfaces of the photoconductors 1Y, 1M, 1C, and 1K are uniformly electrically charged with the charging devices 2Y, 2M, 2C, and 2K, electrostatic latent images are formed by irradiating the laser beam L on the electrically charged surfaces. The electrostatic latent images formed on the surfaces of the photoconductors 1Y, 1M, 1C, and 1K are developed with the development devices 5Y, 5M, 5C, and 5K to obtain Y, M, C, and K toner images on the photoconductors 1Y, 1M, 1C, and 1K. The Y, M, C, and K toner images are superposed and primarily transferred on the front surface of the intermediate transfer belt 8 at the primary transfer nips for the Y, M, C and K. In this manner, a toner image in four colors is formed on the front surface of the intermediate transfer belt 8.

On the other hand, at the sheet feed section, recording sheets P are sent one by one from the sheet feed tray with a sheet feed roller 27 and transported to the pair of registration rollers. The pair of registration rollers are driven at a timing that can be synchronized with the toner image in four colors on the intermediate transfer belt 8 to send the recording sheet P to the secondary transfer nip, and the toner image in four colors on the belt is secondarily transferred on the recording sheet P in a lump. In this manner, a full-color image is formed on the surface of the recording sheet P. The recording sheet P after the full-color image is formed is transported from the secondary transfer nip to the fixing device to apply a fixing process for the toner image.

With respect to the photoconductors 1Y, 1M, 1C, and 1K after the Y, M, C, and K toner images are primarily transferred onto the intermediate transfer belt 8, a cleaning process for residual toner after transfer is performed by the drum cleaning devices 4Y, 4M, 4C, and 4K. Thereafter, after neutralization is performed with a neutralization lamp, the belt is uniformly electrically charged with the charging devices 2Y, 2M, 2C, and 2K to prepare the next image formation. The intermediate transfer belt 8 after the image is primarily transferred onto the recording sheet P, a cleaning process of residual toner after transfer is performed by the belt cleaning device 100.

Figure 2:
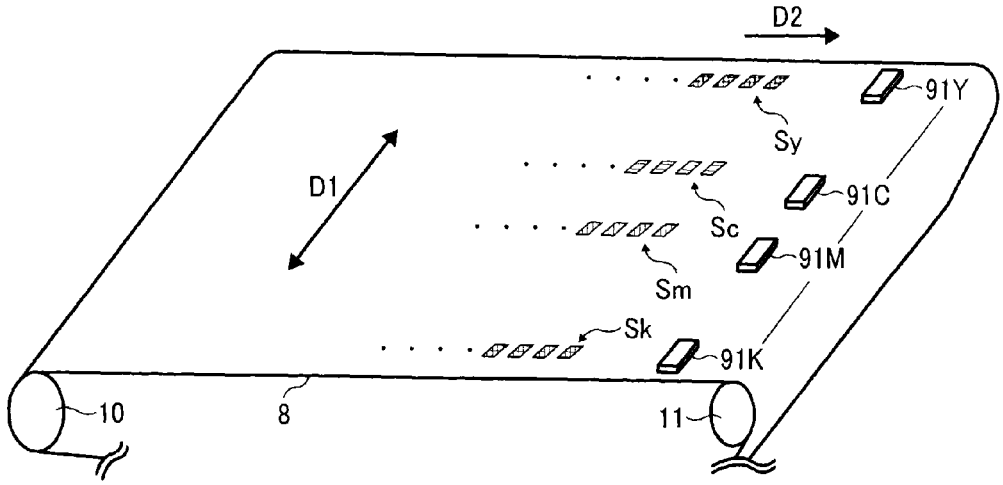
FIG. 2 is an enlarged view of a configuration of a belt cleaning device and a periphery thereof in the image forming apparatus.

On the right of the process unit 6K for K in FIG. 2, an optical sensor unit 90 is disposed to face the front surface of the intermediate transfer belt 8 with a predetermined interval. The optical sensor unit 90, as illustrated in FIG. 2, has a Y optical sensor 91Y, a C optical sensor 91C, an M optical sensor 91M, and a K optical sensor 91K arrayed in the width direction of the intermediate transfer belt 8. Each of all the sensors is formed of a reflective photosensor in which light emitted from a light-emitting element is reflected by the front surface of the intermediate transfer belt 8 and the toner image on the belt, and the reflected light quantity is detected by a light-receiving element. A controller, on the basis of output voltages from these sensors, can detect a toner image on the intermediate transfer belt 8 or detect an image density (amount of adhesion of toner per unit area) of the toner image.

In the printer, in a power-on state or each time a predetermined number of prints are completed, image density control is executed to optimize the image densities of the colors. The image density control, as illustrated in FIG. 2, automatically forms gradation patterns Sk, Sm, Sc, and Sy in colors at positions facing the optical sensors 91Y, 91M, 91C, and 91K on the intermediate transfer belt 8. The gradation patterns in colors constitute of ten toner patches having different image densities and areas of 2 cm×2 cm. Charging potentials of the photoconductors 1Y, 1M, 1C, and 1K obtained when the gradation patterns Sk, Sm, Sc, and Sy in colors are formed are different from a uniform drum charging potential in a print process, and have values that are gradually increased. While a plurality of patch electrostatic latent images to form gradation pattern images by scanning of a laser beam are formed on the photoconductors 1Y, 1M, 1C, and 1K, respectively, the plurality of patch electrostatic latent images are developed with the development devices 5Y, 5M, 5C, and 5K for Y, M, C, and K. In this development, the values of development biases applied to the development rollers for Y, M, C, and K are gradually increased. With the development, Y, M, C, and K gradation patterns are formed on the photoconductors 1Y, 1M, 1C, and 1K, respectively. The gradation pattern images are primarily transferred to be arrayed at predetermined intervals in a main scanning direction of the intermediate transfer belt 8 indicated by arrow D1 in FIG. 2. An amount of adhesion of toner of the toner patch in each of the gradation patterns is 0.1 mg/cm$^2$ at the minimum and 0.55 mg/cm$^2$ at the maximum. When toner charge-per-diameter (Q/d) distributions are measured, the polarities of the toners are almost equalized to the regular charging polarity.

The toner patterns (Sk, Sm, Sc, and Sy) formed on the intermediate transfer belt 8 pass through positions facing the optical sensors 91 with the endless movement of the intermediate transfer belt 8. At this time, the optical sensors 91 receive amounts of light depending on amounts of adhesion of toner per unit area to the toner patches of the gradation patterns, respectively.

On the basis of output voltages from the optical sensors 91 when the toner patches are detected and an adhesion amount conversion algorithm, amounts of adhesion on the toner patches of the toner patterns in colors are calculated. On the basis of the calculated amounts of adhesion, image forming conditions are adjusted. More specifically, on the basis of the results of detection of the amounts of adhesion of toner on the toner patches and development potentials obtained when the toner patches are formed, a function (y=ax+b) representing the linear graph is calculated by regression analysis. Target values of the image densities are assigned to the function to calculate appropriate development biases, so that development biases for Y, M, C, and K are specified.

In the memory, an image formation condition data table is stored in which several tens of kinds of development biases and appropriate drum charging potentials respectively corresponding to the biases are associated with each other. With respect to the process units 6Y, 6M, 6C, and 6K, development biases that are closest to the specified development biases are selected from the image formation condition table to specify drum charging potentials associated with the selected development biases.

Figure 3:
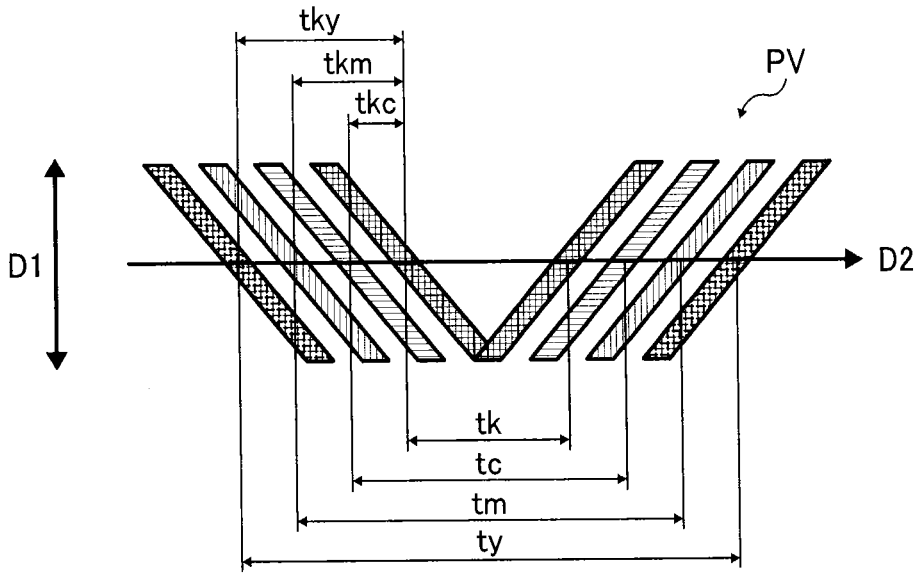
FIG. 3 is an enlarged schematic view of a chevron patch formed on an intermediate transfer belt of the image forming apparatus.

The printer is configured to also perform color shift correction processing when the printer is powered on or when a predetermined number of prints are completed. In the color shift correction processing, color shift detection images called chevron patches PV as shown in FIG. 3 and constituted of Y, M, C, and K toner images are formed at each of one end and the other end of the intermediate transfer belt 8 in the width direction, respectively. The chevron patch PV, as shown in FIG. 3, is a line pattern group in which the Y, M, C, and K toner images are arrayed at predetermined pitches in a belt moving direction that is a sub-scanning direction (indicated by arrow D2) while the toner images are tilted at about 45° relative to the main scanning direction (indicated by arrow D1). An amount of adhesion of the chevron patch PV is about 0.3 mg/cm$^2$.

The color toner images in the chevron patches PV formed at both the ends of the intermediate transfer belt 8 in the width direction are detected. In this manner, positions in the main scanning direction D1 (axial direction of the photoconductor) in the color toner images, positions in the sub-scanning direction (belt moving direction) D2, magnification errors in the main scanning direction D1, and skew from the main scanning direction D1 are detected. The main scanning direction D1 mentioned here is a direction in which a laser beam is phase-shifted on the surface of the photoconductor with reflection on a polygon mirror.

Detection time differences between the Y, M, and C toner images in the chevron patch PV and the K toner image are read by the optical sensors 91. In FIG. 3, the vertical direction corresponds to the main scanning direction D1, and the Y, M, C, and K toner images are sequentially arrayed from the left. Thereafter, K, C, M, and Y toner images having postures different from those of the above Y, M, C, and K toner images by 90° are further arrayed.

On the basis of differences between measured values and ideal values of detection time differences tky, tkm, and tkc obtained with reference to the K color serving as a reference color, deviations of the color toner images in the sub-scanning direction D2, i.e., registration deviations, are calculated. On the amount of registration deviations, every other surface of the polygon mirror in the optical writing unit constituting part of a toner image forming unit, i.e., using one scanning line pitch as one unit, an optical writing start timing for a photoconductor 1 is corrected to reduce the registration deviations of the color toner images.

On the basis of the differences of deviations in sub-scanning direction D2 between both the ends of the belt, tilts (skews) of the color toner images from the main scanning direction D1 are calculated. On the basis of the result, plate tilt correction of an optical reflecting mirror is performed to reduce skew deviations of the color toner images. Processing that corrects an optical writing start timing and a plate tilt on the basis of timings at which the toner images in the chevron patch PV are detected to reduce registration deviations and skew deviations is color shift correction processing. The color shift correction processing can suppress color shift of an image caused by shifting forming positions of the color toner images on the intermediate transfer belt 8 with time due to a change in temperature or the like.

When the image forming operation in a small image area continues, old toner continuously remaining in the development device for a long time increases. For this reason, the toner charging characteristics are deteriorated, and use of the toner in image formation deteriorates image quality (deterioration in development capability and transfer properties). The image forming device includes a refresh mode in which old toner is ejected into a non-image region of the photoconductor 1 at a predetermined timing not to be accumulated in the development device, and, after the toner is ejected, a new toner is supplied to the development device having a decreased toner concentration to refresh the interior of the development device.

A controller stores consumptions of toner of the development devices 5Y, 5M, 5C, and 5K and operation times of the development devices 5Y, 5M, 5C, and 5K therein in advance. At a predetermined timing, the controller examines whether a consumption of toner for an operation time in a predetermined period of each development device is a threshold value or less in each of the developments, and executes the refresh mode to a development device having a consumption of toner that is the threshold value or less.

Figure 4:
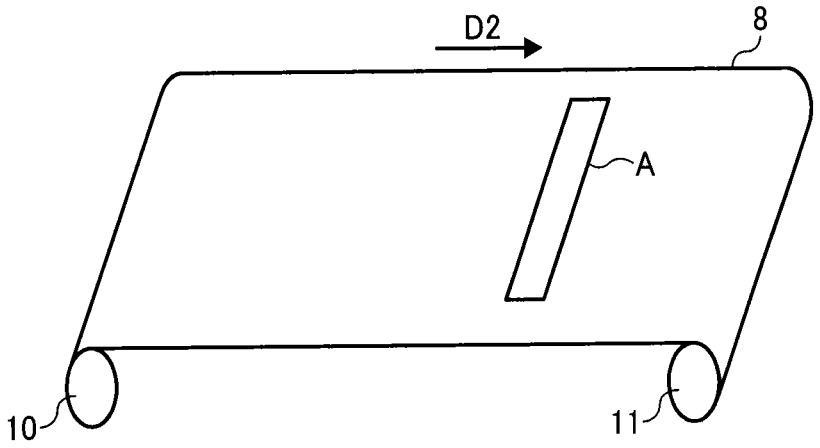
FIG. 4 is a schematic view of the intermediate transfer belt and a toner consumption pattern formed on a surface of the intermediate transfer belt.

When the refresh mode is executed, a toner consumption pattern A is formed in a non-image-forming region corresponding to a region between sheets of the photoconductor 1 and transferred to the intermediate transfer belt 8 (FIG. 4). An amount of adhesion to the toner consumption pattern is determined on the basis of a consumption of toner for an operation time in a predetermined period of the development device, and a maximum amount of adhesion per unit area on the intermediate transfer belt 8 may be about 1.2 mg/cm$^2$. When a toner Q/d distribution of the toner consumption pattern A transferred to the intermediate transfer belt 8 is measured, the charging property is almost equalized to the regular charging polarity. In this embodiment, the size of the toner consumption pattern is set to 25 mm×250 mm.

The color gradation patterns, the chevron patches, and the toner consumption pattern formed on the intermediate transfer belt 8 are collected by the belt cleaning device 100. At this time, the belt cleaning device 100 removes a large amount of toner from the intermediate transfer belt 8. However, a conventional type of cleaning device including a polarity controller and a brush roller or a conventional type of cleaning device including a brush roller for removing toner having a positive polarity and a brush roller for removing toner having a negative polarity may not remove a large amount of toner from the intermediate transfer belt 8. More specifically, such a conventional type of cleaning device may not remove the non-transferred toner images such as the color gradation patterns, the chevron patches, and the toner consumption pattern in a lump. In such a case, the toner on the intermediate transfer belt 8 that cannot be completely cleaned is transferred onto a recording sheet in the next print operation, and an abnormal image may be formed.

Thus, the belt cleaning device 100 of the printer is configured such that non-transferred toner images such as the color gradation patterns, the chevron patches, and the toner consumption pattern can be removed in a lump.

Figure 5:
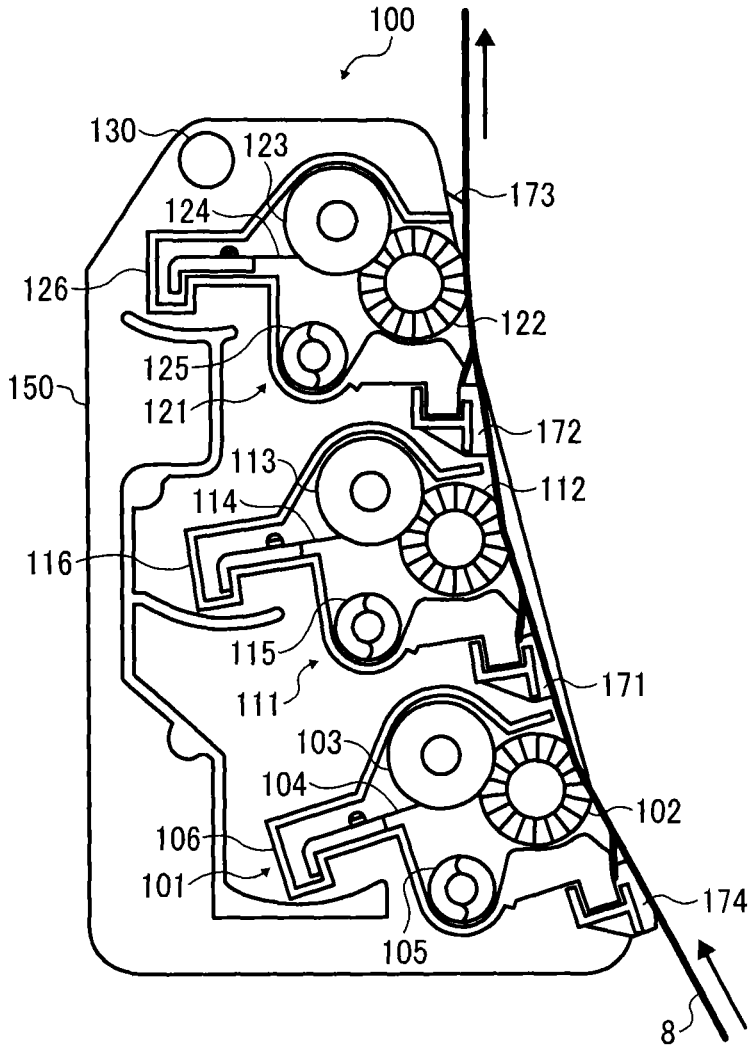
FIG. 5 is an enlarged view of a configuration of the belt cleaning device of the image forming apparatus.

FIG. 5 is an enlarged view of a configuration of the belt cleaning device 100 according to this embodiment. In FIG. 5, the belt cleaning device 100 includes a first sub cleaning unit 101 and a second sub cleaning unit 111 adjacent to and downstream of the first sub cleaning unit 101 in a moving direction of the intermediate transfer belt 8. The belt cleaning device 100 also includes a third sub cleaning unit 121 adjacent to and downstream of the second sub cleaning unit 111 in the moving direction of the intermediate transfer belt 8.

The first sub cleaning unit 101 includes a first cleaning brush roller 102 serving as a cleaner to scrape off post-transfer residual toner from the surface of the intermediate transfer belt 8. The first sub cleaning unit 101 also includes a first collection roller 103 to collect post-transfer residual toner from the first cleaning brush roller 102 by rotating in contact with the first cleaning brush roller 102 and a first scraping blade 104 to scrape post-transfer residual toner from a surface of the first collection roller 103. The first sub cleaning unit 101 further includes a first sub-unit casing 106 serving as a holder. The first sub-unit casing 106 includes a first transport screw 105 to discharge post-transfer residual toner scraped off from the first collection roller 103 to the outside of the first sub-unit casing 106.

Similarly with the first sub cleaning unit 101, the second sub cleaning unit 111 has the following configuration. For example, the second sub cleaning unit 111 includes a second cleaning brush roller 112 serving as a cleaning member, a second collection roller 113, a second scraping blade 114, a second transport screw 115, and a second sub-unit casing 116.

Similarly with the first cleaning sub-unit 101, the third cleaning sub-unit 121 has the following configuration. For example, the third cleaning sub-unit 112 includes a third cleaning brush roller 122 serving as a cleaning member, a third collection roller 123, a third scraping blade 124, a third transport screw 125, and a third sub-unit casing 126.

Each of the first cleaning sub-unit 101, the second cleaning sub-unit 111, and the third cleaning sub-unit 121 is removably mounted relative to a sub-unit holder casing 150 serving as a sub-unit holder of each belt cleaning device.

Most of toner particles constituting the post-transfer residual toner are charged to have a negative polarity that is a regular charging polarity. For the first cleaning sub-unit 101 at the most upstream side of the three cleaning sub-units, the first cleaning brush roller 102 is applied with a cleaning bias of a polarity (positive polarity) opposite the regular charging polarity of toner. Thus, post-transfer residual toner charged with the charging polarity (negative polarity) generated on the intermediate transfer belt 8 is electrostatically captured to a brush of the first cleaning brush roller 102. The first collection roller 103 is applied with a collection bias of positive polarity of a value greater than the cleaning bias. For the belt cleaning device 100, the cleaning bias is set so that about 90% of post-transfer residual toner generated on the surface of the intermediate transfer belt 8 is removed with the first cleaning brush roller 102.

The post-transfer residual toner may slightly include toner charged with the polarity opposite the regular charging polarity. Hence, the second cleaning brush roller 112 of the second cleaning sub-unit 111 is applied with a cleaning bias of the same polarity as the regular charging polarity (negative polarity) of toner. Thus, of the post-transfer residual toner, toner particles charged with the opposite polarity are electrostatically captured to a brush of the second cleaning brush roller 112. The second collection roller 113 is applied with a collection bias of negative polarity of a value greater than the cleaning bias. The second cleaning brush roller 112 acts as a polarity regulator to inject charges of negative polarity, which is the regular charging polarity of toner, to toner particles charged with the opposite polarity to return the toner particles charged with the opposite polarity to the regular polarity.

The third cleaning brush roller 122 of the third cleaning sub-unit 121 is applied with a cleaning bias of positive polarity opposite the regular charging polarity of toner. The third collection roller 123 is applied with a collection bias of positive polarity of a value greater than the cleaning bias.

The second sub-unit casing 116 of the second cleaning sub-unit 111 has a first insulation seal 171 at the vicinity of an opening for exposing the second cleaning brush roller 112 to the outside of the second sub-unit casing 116, to prevent falling of toner particles charged with the opposite polarity. The first insulation seal 171 prevents occurrence of electric discharge between the first cleaning brush roller 102 and the second cleaning brush roller 112. The first insulation seal 171 also prevents migration of toner particles charged with the opposite polarity from the second sub-unit casing 116 to the first sub-unit casing 106.

The third sub-unit casing 126 of the third cleaning sub-unit 121 has a second insulation seal 172 at the vicinity of an opening for exposing the third cleaning brush roller 122 to the outside of the third sub-unit casing 126, to prevent falling of post-transfer residual toner. The second insulation seal 172 prevents occurrence of electric discharge between the third cleaning brush roller 122 and the second cleaning brush roller 112. The second insulation seal 172 also prevents migration of post-transfer residual toner (charged with the regular polarity) from the third sub-unit casing 126 to the second sub-unit casing 116.

The third sub-unit casing 126 of the third cleaning sub-unit 121 has a third insulation seal 173 above an opening for exposing the third cleaning brush roller 122 to the outside of the third sub-unit casing 126. The third insulation seal 173 prevents occurrence of electric discharge between the third cleaning brush roller 122 and the tension roller 16 (illustrated in FIG. 1).

The cleaning brush rollers 102, 112, and 122 include metal rotation shafts 102*a*, 112*a*, 122*a* and brushes 102*b*, 112*b*, 122*b*, respectively. Each of the metal rotation shafts 102*a*, 112*a*, 122*a* is rotationally supported. Each of the brushes 102*b*, 112*b*, 122*b* has a plurality of raising fibers standing on the peripheral surface of the rotation shaft and has an external diameter ϕ of 15 mm to 16 mm. Each of the raising fibers has a two-layered core-sheath structure in which the inside of each of the raising fibers is made of a conductive material such as conductive carbon, and the surface portion of each of the rising fibers is made of an insulating material such as polyester. In this manner, the cores have substantially the same potential as that of the cleaning bias applied to the cleaning brush rollers 102, 112, and 122, and toner can be electrostatically attracted to the surfaces of the raising fibers. As a result, toner particles on the intermediate transfer belt 8 are electrostatically captured to the raising fibers of the cleaning brush rollers 102, 112, and 122.

In some embodiments, the raising fibers of the cleaning brush rollers 102, 112, and 122 are formed of only conductive fibers, not the two-layered core-sheath structure. In some embodiments, fibers are planted to be slanted with respect to a normal direction of the rotation shaft 102*a*, 112*a*, 122*a*. In some embodiments, the raising fibers of the first cleaning brush roller 102 and the third cleaning brush roller 122 applied with a cleaning bias of positive polarity have core-sheath structures, and the raising fibers of the second cleaning brush roller 112 is formed of only conductive fibers. When the raising fibers of the second cleaning brush roller 112 applied with a cleaning bias of negative polarity are formed of only conductive fibers, charge injection from the second cleaning brush roller 112 to toner is facilitated. In this manner, the second cleaning brush roller 112 can equalize the toner on the intermediate transfer belt 8 to the negative polarity. On the other hand, when the raising fibers of the first cleaning brush roller 102 and the third cleaning brush roller 122 have core-sheath structures, charge injection into the toner can be suppressed, thus suppressing positive charging of the toner on the intermediate transfer belt 8. Such a configuration can suppress occurrence of toner not electrostatically removed with the first cleaning brush roller 102 and the third cleaning brush roller 122.

The cleaning brush rollers 102, 112, and 122 are arranged to dig into the intermediate transfer belt 8 by 1 mm. The cleaning brush rollers 102, 112, and 122 are rotated by a driving unit such that the raising fibers move in a direction (counter direction) opposing the moving direction of the intermediate transfer belt 8 at a contact position. At the contact position, the cleaning brush rollers 102, 112, and 122 are rotated to move the rising fibers in the counter direction so that a difference in linear velocity between the intermediate transfer belt 8 and each of the cleaning brush rollers 102, 112, and 122 can be increased. In this manner, a probability of contact to the raising fibers increases in a period until a certain position of the intermediate transfer belt 8 passes through contact areas to the cleaning brush rollers 102, 112, and 122, and the toner can be preferably removed from the intermediate transfer belt 8.

In this embodiment, each of the collection rollers 103, 113, and 123 are made of stainless steel (SUS). In some embodiments, the collection rollers 103, 113, and 123 are made of any other material capable of achieving the following function. The function is to transfer toner adhered to the cleaning brush rollers 102, 112, and 122, from the cleaning brush rollers 102, 112, and 122 to the collection rollers 103, 113, and 123 by potential gradient between the raising fibers and the collection rollers 103, 113, and 123. For example, in some embodiments, each of the collection rollers has a roller resistance log R of from 12Ω to 13Ω obtained by, e.g., covering a conductive metal core with a high-resistance elastic tube having a size of several micrometers to 100 micrometers or coating the conductive metal core with an insulator. Using the stainless steel (SUS) rollers as the collection rollers allows cost reduction or suppression of an application voltage to a low level, and electric power saving can be advantageously achieved. On the other hand, setting the roller resistance log R to be 12Ω to 13Ω allows suppression of electric charge injection into toner in collection of the toner in the collection rollers. As a result, the polarity of toner becomes the same as the polarity of the voltage applied to the collection rollers, thus suppressing a reduction in toner collection efficiency.

Conditions of the cleaning brush rollers 102, 112, and 122 are as follows.

Material of brush: conductive polyester (having a core-sheath structure in which the interior of fiber is made of conductive carbon and the surface of fiber is made of polyester)

Resistance of brush: 10E6Ω to 10E8Ω

Planting density of brush fibers: one hundred thousand per square inch

Diameter of brush fiber: about 25 μm to about 35 μm

Flattening of brush edges: None

Brush diameter ϕ: 14 mm to 22 mm

Depth of brush fibers digging into the intermediate transfer belt 8: 1 mm

The cleaning bias supplied to the first cleaning brush roller 102 is set to such a value that a good cleaning performance can be obtained when a large amount of post-transfer residual toner arise on the intermediate transfer belt 8. The cleaning bias supplied to the second cleaning brush roller 112 is set to a relatively high absolute value so as to inject charges to toner on the intermediate transfer belt 8. Planting density of brush fibers, resistance of brush, fiber diameter, voltage applied, fiber type, and depth at which brush fibers dig into the intermediate transfer belt 8 can be optimized according to a system used, and are not limited to the above-described values. Examples of usable fiber type include nylon, acryl, polyester, and so on.

Conditions of the collection rollers 103, 113, and 123 are as follows.

Material of cored bar of collection roller: SUS 303

Depth of brush fibers digging into collection roller: 1.5 mm

Material of the collection rollers, the depth of brush fibers digging into each collection roller, voltage applied can be optimized for a system used, and are not limited to the above-described values.

Conditions of the scraping blades (104, 114, and 124) are as follows.

Material of the scraping blades: SUS 304

Contact angle of blade: 20°

Thickness of blade: 0.1 mm

Depth of blade digging into collection roller: 1.0 mm

The contact angle of blade, the thickness of blade, and the depth of blade digging into collection roller can be optimized for a system used, and are not limited to the above-described values.

In FIG. 5, as the intermediate transfer belt 8 moves, post-transfer residual toner having passed a secondary transfer nip goes over a contact portion at which the intermediate transfer belt 8 contacts an entry seal 174, and is conveyed to a position of the first cleaning brush roller 102. The first cleaning brush roller 102 is applied with a cleaning bias of a polarity (positive polarity) opposite the regular charging polarity of toner. By action of an electric field formed by a difference in surface potential between the intermediate transfer belt 8 and the first cleaning brush roller 102, toner charged with negative polarity on the intermediate transfer belt 8 are electrostatically adsorbed to the first cleaning brush roller 102. Toner of negative polarity migrated to the first cleaning brush roller 102 is transported to a contact position at which the first cleaning brush roller 102 contacts the first collection roller 103 applied with a collection bias of positive polarity greater than that of the first cleaning brush roller 102. By action of an electric field formed by a difference in surface potential between the first cleaning brush roller 102 and the first collection roller 103, post-transfer residual toner in the brush of the first cleaning brush roller 102 is electrostatically transferred to the first collection roller 103. Then, the transferred residual toner is scraped off from the surface of the first collection roller 103 with the first scraping blade 104 and transported to a toner storage part of the first cleaning sub-unit 101 with the first transport screw 105.

Post-transfer residual toner on the intermediate transfer belt 8, which has not been removed with the first cleaning brush roller 102, includes, for example, toner of negative polarity or weakly charged toner of positive polarity. Such post-transfer residual toner is transported to a contact position at which the intermediate transfer belt 8 contacts the second cleaning brush roller 112. The second cleaning brush roller 112 is applied with a voltage of the same polarity (negative polarity) as the regular charging polarity of toner. By charge injection or electric discharge, the polarity of toner on the intermediate transfer belt 8 is unified to negative polarity. At the same time, by action of an electric field formed by a difference in surface potential between the intermediate transfer belt 8 and the second cleaning brush roller 112, toner charged with negative polarity on the intermediate transfer belt 8 is electrostatically transferred into the brush of the second cleaning brush roller 112. Then, after electrostatically transferred to the second collection roller 113, the transferred residual toner is scraped off from the second collection roller 113 with the second scraping blade 114 and transported to a toner storage part of the second cleaning sub-unit 111 with the second transport screw 115.

Toner of negative polarity having not been removed with the second cleaning brush roller 112 is conveyed to a contact position at which the intermediate transfer belt 8 contacts the third cleaning brush roller 122, with movement of the intermediate transfer belt 8. The amount of residual toner of negative polarity conveyed as described above is quite small. Such residual toner is electrostatically transferred onto the third cleaning brush roller 122 and the third collection roller 123 in turn, and is scraped off from the third collection roller 123 with the third scraping blade 124. Then, residual toner is transported to a toner storage part of the third cleaning sub-unit 121 with the third transport screw 125.

Figure 6:
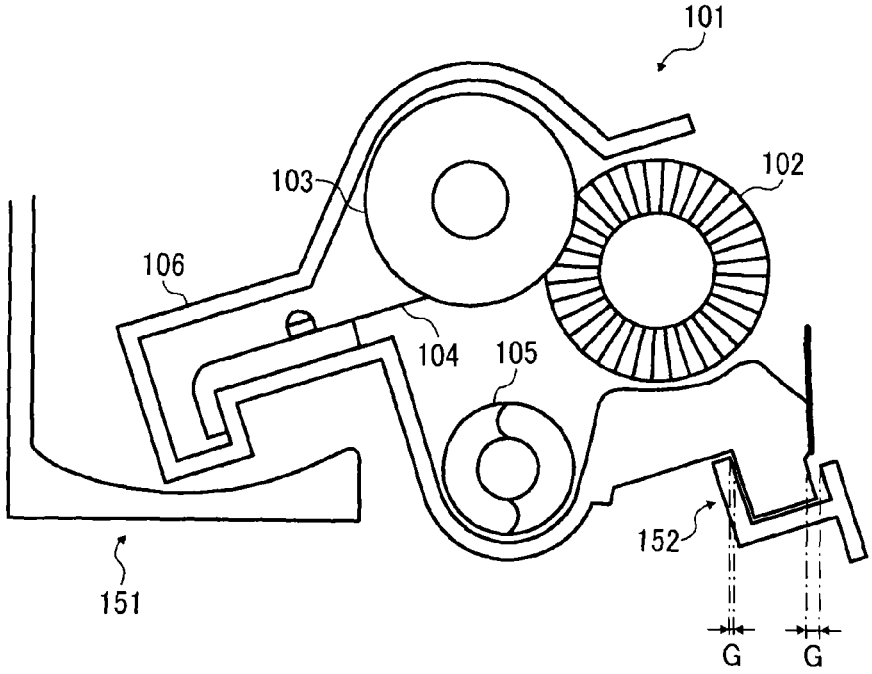
FIG. 6 is an enlarged view of a configuration of a first cleaning sub-unit of the belt cleaning device and its circumference.

FIG. 6 is an enlarged view of a configuration of the first cleaning sub-unit 101 of the cleaning device 100 and its circumference. The sub-unit holder casing 150 of the cleaning device 100 includes two supports, in this example, a first left support 151 and a first right support 152 to support the first cleaning sub-unit 101 so as to be detachably attachable relative to the sub-unit holder casing 150. In a state in which the first cleaning sub-unit 101 is fully set in the sub-unit holder casing 150, as illustrated in FIG. 6, the first sub-unit casing 106 floats up from the first left support 151 and the first right support 152. By contrast, during an operation of sliding the first cleaning sub-unit 101 in a longitudinal direction relative to the sub-unit holder casing 150 for detachment or attachment, the first sub-unit casing 106 is placed on the first left support 151 or the first right support 152.

The first left support 151 supports a left lateral end of the first sub-unit casing 106 of the first cleaning sub-unit 101 in a short direction of the first sub-unit casing 106, from a lower side in a vertical direction. More specifically, the first left support 151 allows movement of the left lateral end of the first sub-unit casing 106 in the short direction while supporting the left lateral end of the first sub-unit casing 106 such that the first sub-unit casing 106 can slide and move in the longitudinal direction of the first sub-unit casing 106 (which is a direction perpendicular to a face of a paper sheet on which FIG. 6 is printed). The first left support 151 has a receive portion to receive the left lateral end in a state of extending in the longitudinal direction. The receive portion allows the left lateral end to be supported so as to slide and move in the longitudinal direction. However, the first left support 151 has no portion to stop movement of the left lateral end in the short direction. Such a configuration allows movement of the left lateral end in the short direction.

The first right support 152 supports a right lateral end of the first sub-unit casing 106 of the first cleaning sub-unit 101 in a short direction of the first sub-unit casing 106, from a lower side in a vertical direction. More specifically, the first right support 152 has a receive portion to receive the right lateral end of the first sub-unit casing 106 in a state of extending in the longitudinal direction of the first sub-unit casing 106 and support the left lateral end so as to be slidable in the longitudinal direction. Besides the receive portion, the first right support 152 has a left side wall located at a left side of the right lateral end of the first sub-unit casing 106 and a right side wall located at a right side of the right lateral end of the first sub-unit casing 106. The right lateral end of the first sub-unit casing 106 is inserted between the left side wall and the right side wall of the first right support 152. The distance between the left side wall and the right side wall is set to be larger than a length of the right lateral end of the first sub-unit casing 106 in the short direction. Accordingly, as illustrated in FIG. 6, gaps G are formed between the right lateral end of the first sub-unit casing 106 and the left side wall of the first right support 152 and between the right lateral end of the first sub-unit casing 106 and the right side wall of the first right support 152. The first right support 152 allows movement of the right lateral end of the first sub-unit casing 106 in the short direction within a total size of the gaps G.

In such a configuration, the size of the first sub-unit casing 106 serving as a holder in the short direction might become larger than the designed size within a movable range of the first sub-unit casing 106. In such a case, the first sub-unit casing 106 can be inserted between the first left support 151 and the first right support 152 and supported with the first left support 151 and the first right support 152. Thus, even if the first sub-unit casing 106 has a dimensional error or extends in the short direction, the first cleaning sub-unit 101 can be installed to the sub-unit holder casing 150.

Figure 7:
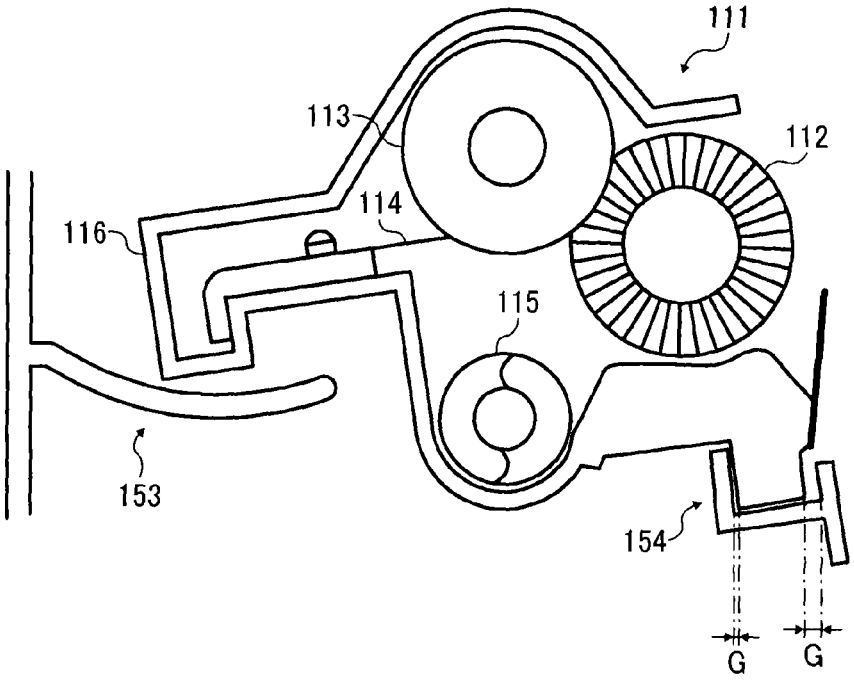
FIG. 7 is an enlarged view of a configuration of a second cleaning sub-unit of the belt cleaning device and its circumference.

FIG. 7 is an enlarged view of a configuration of the second cleaning sub-unit 111 of the cleaning device 100 and its circumference. The sub-unit holder casing 150 of the cleaning device 100 includes two supports, in this example, a second left support 153 and a second right support 154 to support the second cleaning sub-unit 111 so as to be detachably attachable relative to the sub-unit holder casing 150. In a state in which the second cleaning sub-unit 111 is fully set in the sub-unit holder casing 150, as illustrated in FIG. 7, the second sub-unit casing 116 floats up from the second left support 153 and the second right support 154. By contrast, during an operation of sliding the second cleaning sub-unit 111 in a longitudinal direction relative to the sub-unit holder casing 150 for detachment or attachment, the second sub-unit casing 116 is placed on the second left support 153 or the second right support 154.

The second left support 153 supports a left lateral end of the second sub-unit casing 116 of the second cleaning sub-unit 111 in a short direction of the second sub-unit casing 116, from a lower side in a vertical direction. The second left support 153 allows movement of the left lateral end of the second sub-unit casing 116 in the short direction while supporting the left lateral end of the second sub-unit casing 116 such that the second sub-unit casing 116 can slide and move in the longitudinal direction of the second sub-unit casing 116. The second right support 154 supports a right lateral end, the other end of the second sub-unit casing 116 in the short direction of the second sub-unit casing 116, from a lower side in the vertical direction. The second right support 154 has a receive portion to receive the right lateral end of the second sub-unit casing 116 in a state of extending in the longitudinal direction of the second sub-unit casing 116 and support the left lateral end so as to be slidable in the longitudinal direction. Besides the receive portion, the second right support 154 further has a left side wall and a right side wall. The right lateral end of the second sub-unit casing 116 is inserted between the left side wall and the right side wall of the second right support 154. The distance between the left side wall and the right side wall is set to be larger than a length of the right lateral end of the first sub-unit casing 106 in the short direction. Accordingly, as illustrated in FIG. 7, gaps G are formed between the right lateral end of the second sub-unit casing 116 and the left side wall of the second right support 154 and between the right lateral end of the second sub-unit casing 116 and the right side wall of the second right support 154. The second right support 154 allows movement of the right lateral end of the second sub-unit casing 116 in the short direction within a total size of the gaps G.

For such a configuration, even if the second sub-unit casing 116 has a dimensional error or extends in the short direction, the second cleaning sub-unit 111 can be installed to the sub-unit holder casing 150.

Figure 8:
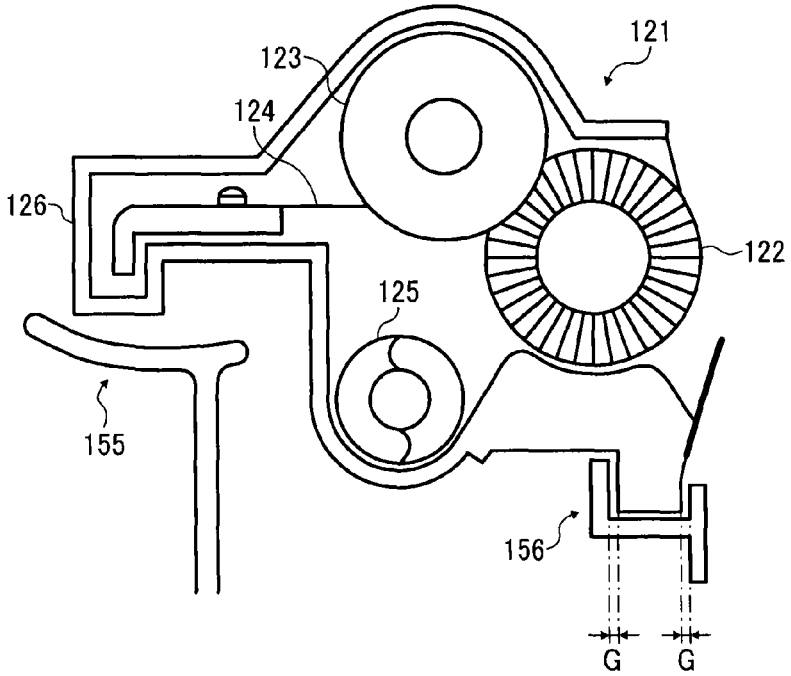
FIG. 8 is an enlarged view of a configuration of a third cleaning sub-unit of the belt cleaning device and its circumference.

FIG. 8 is an enlarged view of a configuration of the third cleaning sub-unit 121 of the cleaning device 100 and its circumference. The sub-unit holder casing 150 of the cleaning device 100 includes two supports, in this example, a third left support 155 and a third right support 156 to support the third cleaning sub-unit 121 so as to be detachably attachable relative to the sub-unit holder casing 150. In a state in which the third cleaning sub-unit 121 is fully set in the sub-unit holder casing 150, as illustrated in FIG. 8, the third sub-unit casing 126 floats up from the third left support 155 and the third right support 156. By contrast, during an operation of sliding the third cleaning sub-unit 121 in a longitudinal direction relative to the sub-unit holder casing 150 for detachment or attachment, the third sub-unit casing 126 is placed on the third left support 155 or the third right support 156.

The third left support 155 supports a left lateral end, one end of the third sub-unit casing 126 of the third cleaning sub-unit 121 in a short direction of the third sub-unit casing 126, from a lower side in a vertical direction. The third left support 155 allows movement of the left lateral end of the third sub-unit casing 126 in the short direction while supporting the left lateral end of the third sub-unit casing 126 such that the third sub-unit casing 126 can slide and move in the longitudinal direction of the third sub-unit casing 126. The third right support 156 supports a right lateral end, the other end of the third sub-unit casing 126 in the short direction of the third sub-unit casing 126, from a lower side in the vertical direction. The third right support 156 has a receive portion to receive the right lateral end of the third sub-unit casing 126 in a state of extending in the longitudinal direction of the third sub-unit casing 126 and support the left lateral end so as to be slidable in the longitudinal direction. Besides the receive portion, the third right support 156 further has a left side wall and a right side wall. The right lateral end of the third sub-unit casing 126 is inserted between the left side wall and the right side wall of the third right support 156. The distance between the left side wall and the right side wall is set to be larger than a length of the right lateral end of the third sub-unit casing 126 in the short direction. Accordingly, as illustrated in FIG. 8, gaps G are formed between the right lateral end of the third sub-unit casing 126 and the left side wall of the third right support 156 and between the right lateral end of the third sub-unit casing 126 and the right side wall of the third right support 156. The third right support 156 allows movement of the right lateral end of the third sub-unit casing 126 in the short direction within a total size of the gaps G.

For such a configuration, even if the third sub-unit casing 126 has a dimensional error or extends in the short direction, the third cleaning sub-unit 121 can be installed to the sub-unit holder casing 150.

The first cleaning sub-unit 101, the second cleaning sub-unit 111, and the third cleaning sub-unit 121 are pushed and installed into the sub-unit holder casing 150 while being moved to slide from a front side to a rear side in a direction perpendicular to a surface of a paper sheet on which FIG. 1 is printed. By contrast, the first cleaning sub-unit 101, the second cleaning sub-unit 111, and the third cleaning sub-unit 121 are removed from the sub-unit holder casing 150 while being moved to slide from the rear side to the front side in the direction perpendicular to the surface of the paper sheet on which FIG. 1 is printed. Thus, in installing or removing the cleaning sub-units, an operator inserts or extract the cleaning sub-units in front of the image forming apparatus illustrated in FIG. 1. Hereinafter, the term "front (side)" represents a forward side of the image forming apparatus illustrated in FIG. 1 in the direction perpendicular to the surface of the paper sheet on which FIG. 1 is printed. The term "back (side)" represents a rearward side of the image forming apparatus illustrated in FIG. 1 in the direction.

Figure 9:
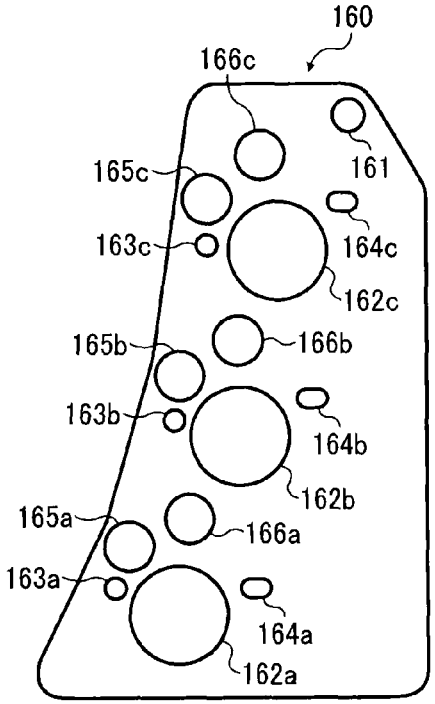
FIG. 9 is a back view of a back side plate of a sub-unit holder casing of the belt cleaning device.

FIG. 9 is a back view of a back side plate 160 of the sub-unit holder casing 150. In FIG. 9, the back side plate 160 is shown from the back side of the sub-unit holder casing 150. The back side plate 160 includes a first storage receiving hole 162*a*, a first main-positioning-pin receiving hole 163*a*, a first sub-positioning-pin receiving hole 164*a*, and a first collection-bias-pin receiving hole 166*a* which correspond to the first cleaning sub-unit. The back side plate 160 further includes a first cleaning-bias-pin receiving hole 165*a*. The back side plate 160 includes a second storage receiving hole 162*b*, a second main-positioning-pin receiving hole 163*b*, a second sub-positioning-pin receiving hole 164*b*, a second collection-bias-pin receiving hole 166*b*, and a second cleaning-bias-pin receiving hole 165*b* which correspond to the second cleaning sub-unit. The back side plate 160 includes a third storage receiving hole 162*c*, a third main-positioning-pin receiving hole 163*c*, a third sub-positioning-pin receiving hole 164*c*, a third collection-bias-pin receiving hole 166*c*, and a third cleaning-bias-pin receiving hole 165*c* which correspond to the third cleaning sub-unit. The back side plate 160 further includes a drive-shaft receiving hole 161.

Figure 10:
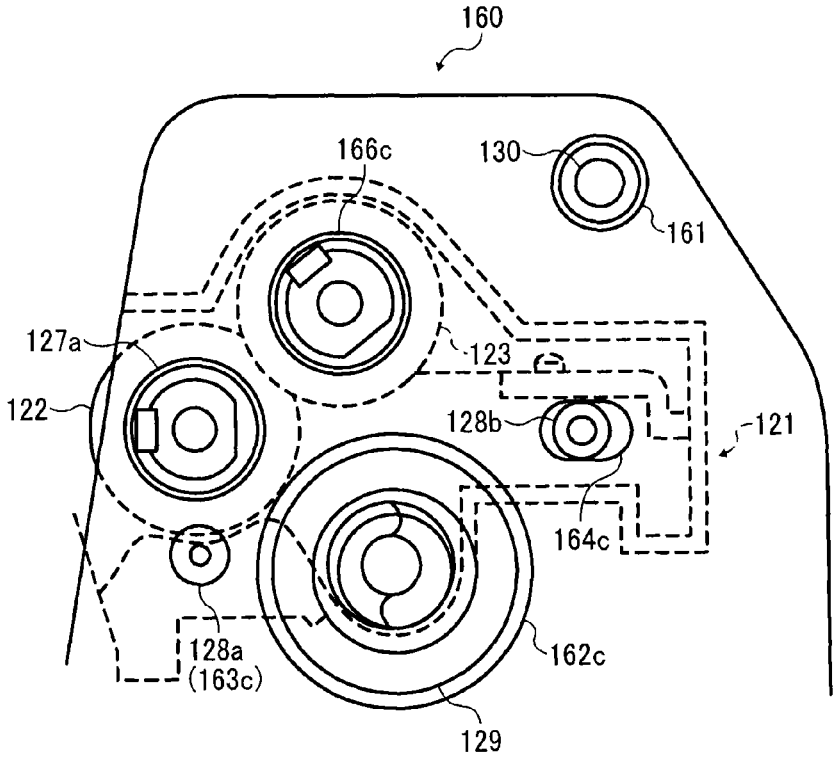
FIG. 10 is a back view of an upper portion of the back side plate and the third sub cleaning unit.

FIG. 10 is a back view of an upper portion of the back side plate 160 and the third cleaning sub-unit 121. In FIG. 10, a drive shaft 130 of the belt cleaning device passes through the drive-shaft receiving hole 161 of the back side plate 160. Accordingly, a rear end of the drive shaft 130 protrudes backward beyond the back side plate 160. Such a configuration allows a coupler of the rear end to be coupled with a coupler of an end of a drive shaft disposed at the apparatus body.

A circular toner storage 129 of the third cleaning sub-unit 121 passes through the third storage receiving hole 162*c* of the back side plate 160. The toner storage 129 protrudes in a cylindrical shape beyond the back side plate of the third sub-unit casing of the third cleaning sub-unit 121. A clearance is disposed between an inner wall of the third storage receiving hole 162*c* and the toner storage 129. Passing of the toner storage 129 through the third storage receiving hole 162*c* of the back side plate 160 allows the following operation. For example, by rotating the toner storage 129 screwed on the back side plate in a state in which the belt cleaning device 100 is removed from the apparatus body, the toner storage 129 can be removed from the back side plate of the third sub-unit casing. Then, interior waste toner can be discarded.

Figure 11:
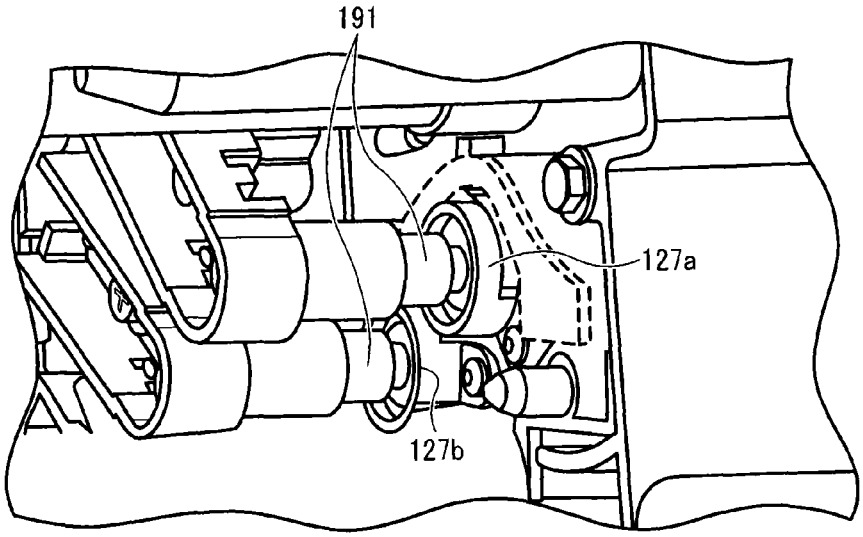
FIG. 11 is a partial, enlarged perspective view of the third cleaning sub-unit and joint caps.

A third cleaning-bias pin 127*a* of the third cleaning sub-unit 121 passes through the third cleaning-bias-pin receiving hole 165*c* of the back side plate 160. The third cleaning-bias pin 127*a* protrudes backward beyond the back side plate of the third sub-unit casing and conducts the third cleaning brush roller 122 via a metal bearing. A clearance is disposed between an inner wall of the third cleaning-bias-pin receiving hole 165*c* and the third cleaning-bias pin 127*a*. Passing the rear end of the third cleaning-bias pin 127*a* through the third cleaning-bias-pin receiving hole 165*c* allows the following operation. For example, as illustrated in FIG. 11, a joint cap 191 disposed at the apparatus body is jointed to the rear end of the third cleaning-bias pin 127*a*. A cleaning bias is supplied from the joint cap 191 to the third cleaning brush roller 122 via the third cleaning-bias pin 127*a* and the metal bearing.

In FIG. 10, a third cleaning-bias pin 127*b* of the third cleaning sub-unit 121 passes through the third collection-bias-pin receiving hole 166*c* of the back side plate 160. The third cleaning-bias pin 127*b* protrudes backward beyond the back side plate of the third sub-unit casing and conducts the third collection roller 123 via a metal bearing. A clearance is disposed between an inner wall of the third collection-bias-pin receiving hole 166*c* and the third cleaning-bias pin 127*b*. Passing a rear end of the third cleaning-bias pin 127*b* through the third collection-bias-pin receiving hole 166*c* allows the following operation. For example, as illustrated in FIG. 11, a joint cap 191 disposed at the apparatus body is jointed to the rear end of the third cleaning-bias pin 127*b*. A cleaning bias is supplied from the joint cap 191 to the third the collection roller 123 via the third cleaning-bias pin 127*b* and the metal bearing.

In FIG. 10, a third back main-positioning pin 128*a* of the third cleaning sub-unit 121 is fitted in the third main-positioning-pin receiving hole 163*c* of the back side plate 160. The third back main-positioning pin 128*a* protrudes beyond the back side plate of the third sub-unit casing of the third cleaning sub-unit 121. No clearance is disposed between an inner wall of the third main-positioning-pin receiving hole 163*c* and the third back main-positioning pin 128*a*. The inner wall of the third main-positioning-pin receiving hole 163*c* and the third back main-positioning pin 128*a* closely contact with each other. Thus, the rear end of the third cleaning sub-unit 121 is positioned.

A third back sub-positioning pin 128*b* of the third cleaning sub-unit 121 is fitted in the third sub-positioning-pin receiving hole 164*c* of the back side plate 160. The third back sub-positioning pin 128*b* protrudes beyond the back side plate of the third sub-unit casing of the third cleaning sub-unit 121. Of four inner walls, i.e., upper, lower, left, and right inner walls of the third sub-positioning-pin receiving hole 164*c*, no clearance is disposed between the third back sub-positioning pin 128*b* and each of the upper and lower inner walls of the third sub-positioning-pin receiving hole 164*c*. By contrast, a clearance is disposed between the third back sub-positioning pin 128*b* and each of the left and right inner walls of the third sub-positioning-pin receiving hole 164*c*.

Figure 12:
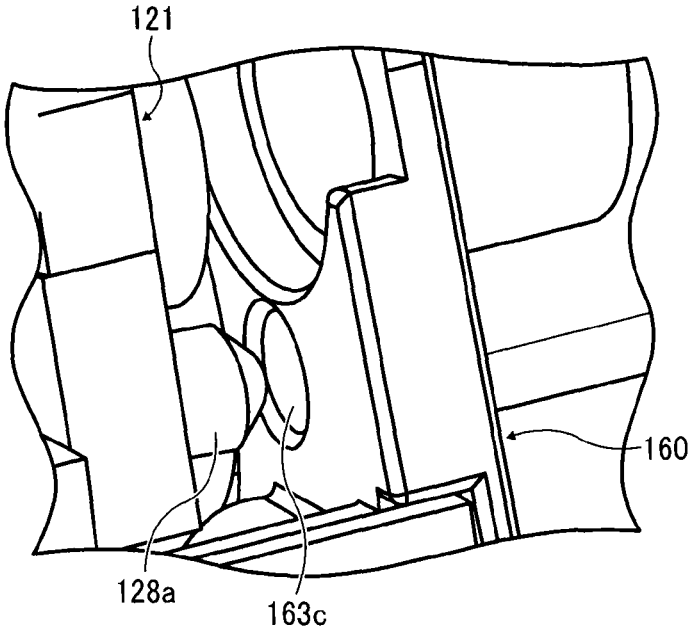
FIG. 12 is a partial, enlarged perspective view of a third back main-positioning pin of the third cleaning sub-unit and the back side plate of the sub-unit holder casing.

As illustrated in FIG. 12, the third back main-positioning pin 128*a* of the third cleaning sub-unit 121 is tapered. When the third cleaning sub-unit 121 is pushed into the sub-unit holder casing from the front side to the back side of the image forming apparatus, a leading edge of the third back main-positioning pin 128*a* enters the third main-positioning-pin receiving hole 163*c* even if the position of the third cleaning sub-unit 121 is slightly deviated from the sub-unit holder casing. Then, as the third cleaning sub-unit 121 is further pushed into the sub-unit holder casing, a bottom portion of the third back main-positioning pin 128*a* slides against the inner wall of the third main-positioning-pin receiving hole 163*c*. The bottom portion of the third back main-positioning pin 128*a* closely contacts the entire inner wall of the third main-positioning-pin receiving hole 163*c*.

Figure 13:
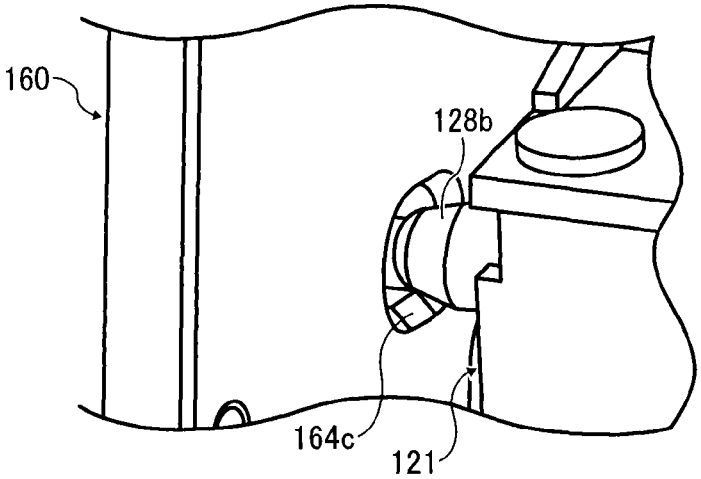
FIG. 13 is a partial, enlarged perspective view of a third back sub-positioning pin of the third cleaning sub-unit and the back side plate of the sub-unit holder casing.

As illustrated in FIG. 13, the third back sub-positioning pin 128*b* of the third cleaning sub-unit 121 is tapered. When the third cleaning sub-unit 121 is pushed into the sub-unit holder casing from the front side to the back side of the image forming apparatus, a leading edge of the third back sub-positioning pin 128*b* enters the third sub-positioning-pin receiving hole 164*c* even if the position of the third cleaning sub-unit 121 is slightly deviated from the sub-unit holder casing. Then, as the third cleaning sub-unit 121 is further pushed into the sub-unit holder casing, a bottom portion of the third back sub-positioning pin 128*b* slides against the inner wall of the third sub-positioning-pin receiving hole 164*c*. Then, the bottom portion of the third back sub-positioning pin

128*b* closely contacts the entire inner wall of the third sub-positioning-pin receiving hole 164*c*.

The positioning of a rear end of the third sub-unit casing 126 in the longitudinal direction is completed at the following timing. That is, when the bottom portion of the third back main-positioning pin 128*a* closely contacts the entire inner wall of the third main-positioning-pin receiving hole 163*c* and the bottom portion of the third back sub-positioning pin 128*b* closely contacts the entire inner wall of the third sub-positioning-pin receiving hole 164*c*, the rear end of the third sub-unit casing 126 is positioned in the longitudinal direction. A bottom of the rear end of the third sub-unit casing 126 thus positioned floats up from the third left support 155 or the third right support 156.

In FIG. 10, the third back main-positioning pin 128*a* is placed near the third cleaning-bias pin 127*a* to which a high-voltage cleaning bias is applied. Accordingly, if the third back main-positioning pin 128*a* is made of metal, electric discharge might occur between the third cleaning-bias pin 127*a* and the third back main-positioning pin 128*a*. Hence, for the image forming apparatus according to this embodiment, the third back main-positioning pin 128*a* is made of insulating resin material. By contrast, the third back sub-positioning pin 128*b* is placed at a position relatively away from the third cleaning-bias pin 127*a* or the third cleaning-bias pin 127*b* to which a high-voltage collection bias is applied. Accordingly, electric discharge does not occur between the third back sub-positioning pin 128*b* and the third cleaning-bias pin 127*a* or the third cleaning-bias pin 127*b*. Hence, in this embodiment, the third back sub-positioning pin 128*b* is made of metal.

In the above description, the relation between the components at the rear end of the third cleaning sub-unit 121 and the holes of the back side plate 160 is described. The same goes for the relation between components at the rear end of the first cleaning sub-unit 101 and corresponding holes of the back side plate 160. The same also goes for the relation between components at the rear end of the second cleaning sub-unit 111 and corresponding holes of the back side plate 160.

Figure 14:
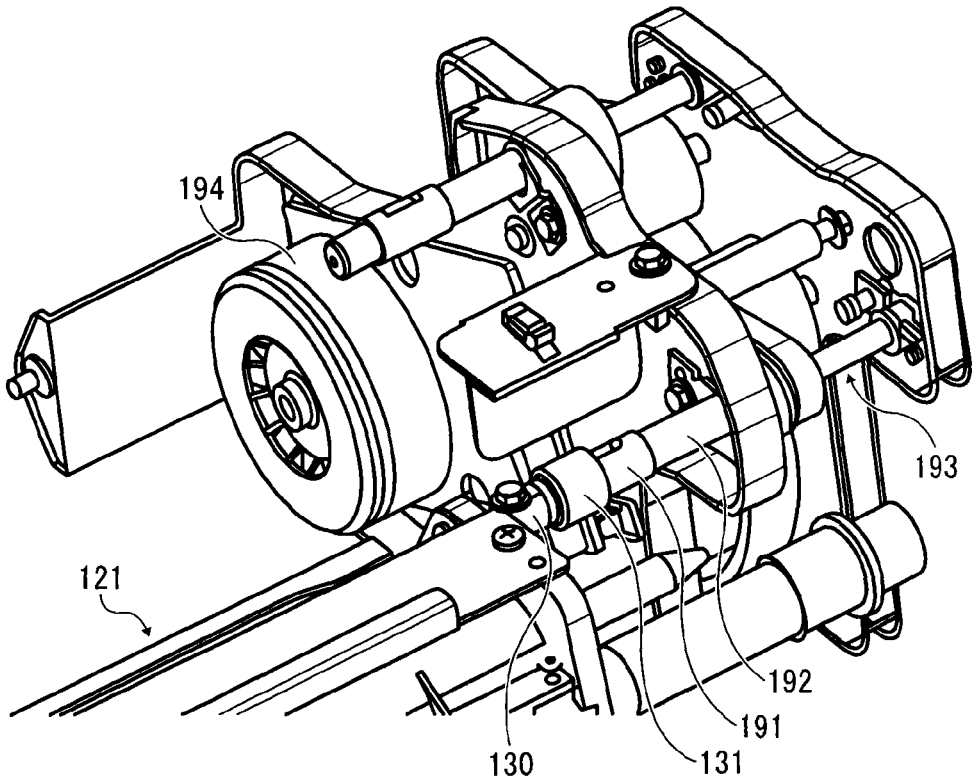
FIG. 14 is a perspective view of a belt drive assembly of a transfer unit of the image forming apparatus and a portion of the third sub cleaning unit according to an embodiment of this disclosure.

FIG. 14 is a perspective view of a belt drive assembly of the transfer unit 7 and a portion of the third cleaning sub-unit 121 according to an embodiment of this disclosure. In FIG. 14, the belt drive assembly includes an output coupling 191, a drive output shaft 192, a drive transmitter 193, and a drive motor 194. The drive transmitter 193 includes, e.g., a timing belt. The belt drive assembly is mounted on a unit back side plate of the transfer unit 7. When the drive motor 194 starts rotating, a rotation driving force is transmitted to the drive output shaft 192 via the drive transmitter 193, thus rotating the drive output shaft 192. The output coupling 191 is fixed at a leading edge of the drive output shaft 192.

In the belt cleaning device, as illustrated in FIG. 10, the drive shaft 130 passes through the drive-shaft receiving hole 161 of the back side plate 160 of the sub-unit holder casing 150. The drive shaft 130 passes through a drive-shaft receiving hole of a front side plate of the sub-unit holder casing and the drive-shaft receiving hole 161 of the back side plate 160 via an interior of the sub-unit holder casing. The rear end of the drive shaft 130 protrudes backward beyond the back side plate 160. FIG. 14 shows the rear end of the drive shaft 130 thus protruding backward. As illustrated in FIG. 14, an input coupling (coupler) 131 is secured on the rear end, which is coupled with the output coupling 191 of the belt drive assembly. Thus, the rotation drive of the drive output shaft 192 is transmitted to the drive shaft 130 to rotate the drive shaft 130.

Figure 15:
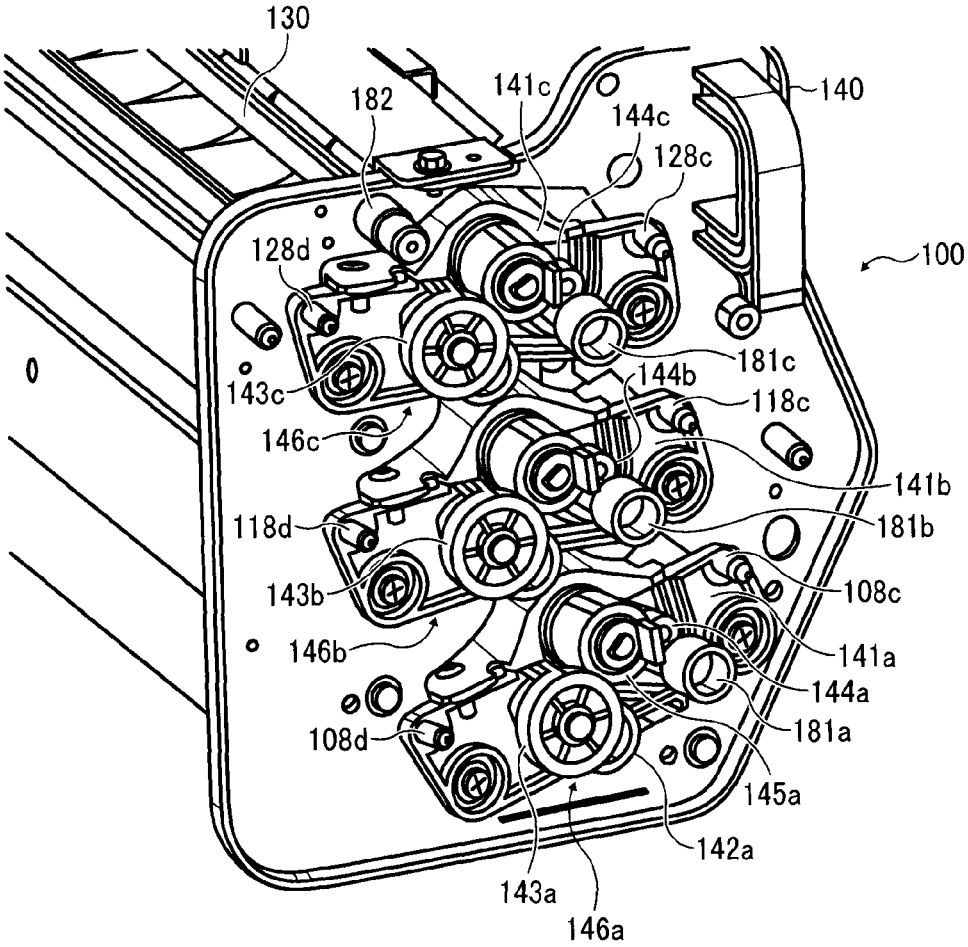
FIG. 15 is a partial, enlarged perspective view of a front end of the belt cleaning device.

FIG. 15 is a partial, enlarged perspective view of a front end of the belt cleaning device 100. A front side plate 140 of the belt cleaning device 100 rotatably supports the front ends of the cleaning sub-units 191, 111, and 121 and the front end of the drive shaft 130.

A first sub-unit faceplate 141*a* is fixed at the front side of the front side plate 140 with a bolt. Each of the first sub-unit faceplate 141*a* and the front side plate 140 includes a first main-positioning-pin receiving hole. The first main-positioning-pin receiving hole of the first sub-unit faceplate 141*a* and the front side plate 140 are communicated with each other. Each of the first sub-unit faceplate 141*a* and the front side plate 140 includes a first sub-positioning-pin receiving hole. The first sub-positioning-pin receiving hole of the first sub-unit faceplate 141*a* and the front side plate 140 are communicated with each other.

A first front main-positioning pin 108*c* and a first front sub-positioning pin 108*d* protrudes from the front side plate of the sub-unit casing of the first cleaning sub-unit 101. When the first sub-unit faceplate 141*a* is secured to the front side plate 140 of the sub-unit holder casing 150, the front end of the first cleaning sub-unit 101 is positioned as follow. In other words, the first front sub-positioning pin 108*d* of the first cleaning sub-unit 101 fits in the first sub-positioning-pin receiving holes of the front side plate 140 and the first sub-unit faceplate 141*a*. Simultaneously, the first front main-positioning pin 108*c* of the first cleaning sub-unit 101 fits in the first main-positioning-pin receiving holes of the front side plate 140 and the first sub-unit faceplate 141*a*. Thus, positioning is performed.

In this positioning, a floor of the front end of the sub-unit casing of the first cleaning sub-unit 101 floats up from the first left support (151 in FIG. 6) or the first right support (152 in FIG. 6). Ahead of this, a floor of the rear end of the sub-unit casing of the first cleaning sub-unit 101 already floats up from the first left support (151 in FIG. 6) or the first right support (152 in FIG. 6) with positioning of the rear end. When the first sub-unit faceplate 141*a* is secured to the front side plate 140 to position the front end of the first cleaning sub-unit 101, the entire floor of the sub-unit casing of the first cleaning sub-unit 101 floats up from the first left support or the first right support. As described above, by floating the entire floor of the sub-unit casing up with positioning, the sub-unit casing can be securely positioned regardless of dimensional error, extension, or deformation of the sub-unit casing. By contrast, if the sub-unit casing is positioned with the floor of the sub-unit casing attached, the orientation of the sub-unit casing might be not be secured because of dimensional error, extension, or deformation of the sub-unit casing, thus hampering positioning of the sub-unit casing.

The first sub-unit faceplate 141*a* supports a first drive transmitter 146*a* including, e.g., a first collection gear 142*a*, a first screw gear 143*a*, a first cleaning pulley gear 144*a*, and a first relay pulley gear 145*a*. Each of the first collection gear 142*a*, the first screw gear 143*a*, the first cleaning pulley gear 144*a*, the first relay pulley gear 145*a* is rotatably supported with the first sub-unit faceplate 141*a*.

The first collection gear 142*a* is coupled with a shaft of the first collection roller 103 with a coupling at a back side of the first sub-unit faceplate 141*a*. The first screw gear 143*a* is coupled with a shaft of the first transport screw 105 with a coupling at the back side of the first sub-unit faceplate 141*a*. The first cleaning pulley gear 144*a* is coupled with a member of the first cleaning brush roller 102 with a coupling at the back side of the first sub-unit faceplate 141*a*.

A gear portion of the first relay pulley gear 145*a* engages the first collection gear 142*a*. Thus, the rotation drive of the first relay pulley gear 145*a* is transmitted to the first collection gear 142*a* to rotate the first collection roller 103 inside the first cleaning sub-unit 101. As the first collection gear 142*a* is rotated, the first screw gear 143*a* engaging the first collection gear 142*a* rotates, thus rotating the first transport screw 105 inside the first cleaning sub-unit 101.

A timing belt is stretched over the first relay pulley gear 145*a* and the first cleaning pulley gear 144*a*. Thus, the rotation drive of the first cleaning pulley gear 144*a* is transmitted to the first relay pulley gear 145*a*. As the first cleaning pulley gear 144*a* rotates, the first cleaning brush roller 102 is rotated inside the first cleaning sub-unit 101.

A drive receive coupling 181*a* serving as a joint coupler is secured at the front edge of the first cleaning pulley gear 144*a* so as to rotate coaxially with the first cleaning pulley gear 144*a*. A drive receive coupling 181*b* serving as a joint coupler is secured at a front edge of a second cleaning pulley gear 144*b* so as to rotate coaxially with the second cleaning pulley gear 144*b*. A drive receive coupling 181*c* serving as a joint coupler is secured at a front edge of a third cleaning pulley gear 144*c* so as to rotate coaxially with the third cleaning pulley gear 144*c*.

In the above description, the positioning of the front end of the first cleaning sub-unit 101 in the longitudinal direction is described. In the same manner, the front end of the second cleaning sub-unit 111 or the third cleaning sub-unit 121 is positioned. In the above description, the first drive transmitter 146*a* of the first cleaning sub-unit 101 is described. Likewise, a second drive transmitter 146*b* of the second cleaning sub-unit 111 or a third drive transmitter 146*c* of the third cleaning sub-unit 121 has a similar configuration to that of the first drive transmitter 146*a* of the first cleaning sub-unit 101.

As illustrated in FIG. 14, the rotation drive transmitted to the drive shaft 130 at the rear side of the belt cleaning device is transmitted to the front side of the belt cleaning device 100 (see FIG. 15) via the drive shaft 130. For example, the front end of the drive shaft 130 protrudes beyond the front side plate 140 through a through-hole of the front side plate 140 of the sub-unit holder casing. An output coupling 182 is secured to the front end of the drive shaft 130. The output coupling 182 is coupled with a coupling of a transmission assembly.

In this printer, a drive transmission system of the belt cleaning device 100 is centered on the front side of the front side plate 140. By contrast, joint caps 191 to apply cleaning bias and collection bias are centered on the rear side of the back side plate 160. Thus, a layout of preventing joint caps or bias pins applied with high voltage from approaching to the rotation metal shaft of drive transmission system is achieved, thus preventing electric discharge between the rotation metal shaft and the joint caps or bias pins.

Figure 16:
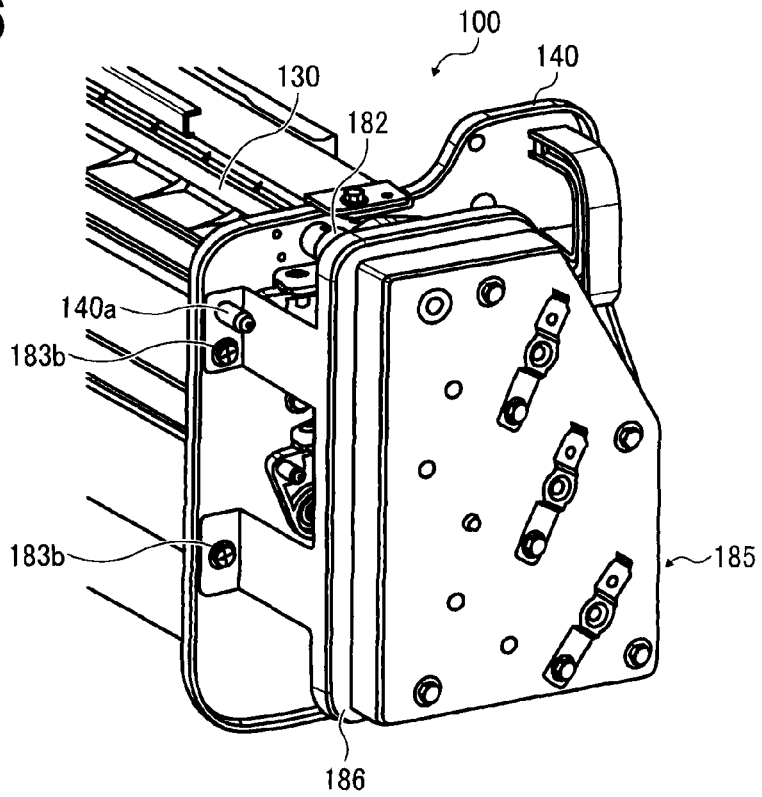
FIG. 16 is a perspective view of a part of the belt cleaning device with a transmission assembly mounted on the front side plate, seen from a front side of the belt cleaning device.
Figure 17:
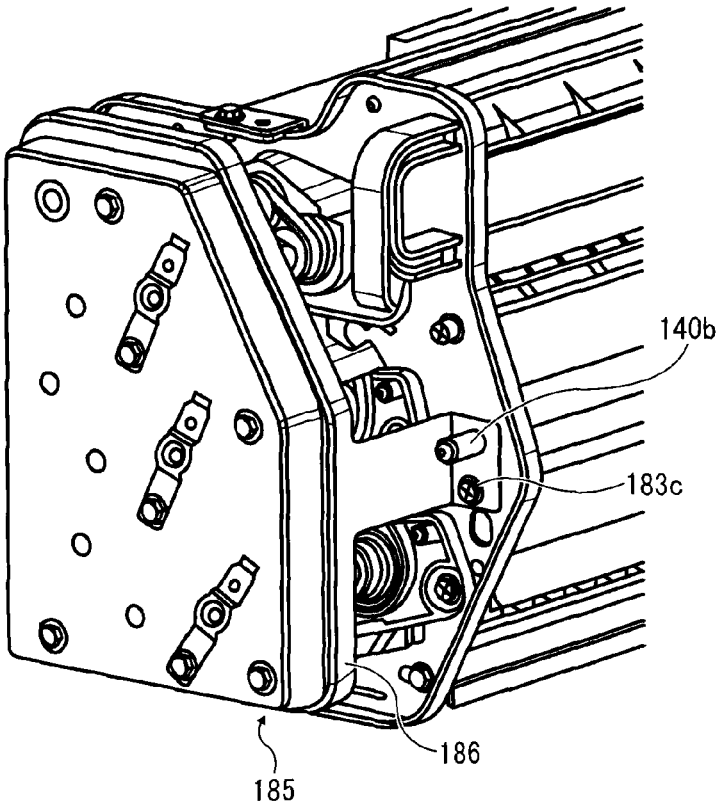
FIG. 17 is a perspective view of a part of the belt cleaning device with the transmission assembly mounted on the front side plate, seen from the front side of the belt cleaning device and a different angle from that of FIG. 16.

Next, a configuration of an image forming apparatus according to an embodiment of this disclosure is described below. FIG. 16 is a perspective view of a part of the belt cleaning device 100 with a transmission assembly 185 mounted on the front side plate 140, seen from the front side of the belt cleaning device 100. FIG. 17 is a perspective view of a part of the belt cleaning device 100 with the transmission assembly 185 mounted on the front side plate 140, seen from the front side of the belt cleaning device 100 and a different angle from that of FIG. 16. A first positioning pin 140*a* and a second positioning ping 140*b* protrude from the front side plate 140. By contrast, a casing 186 of the transmission assembly 185 has a first positioning hole and a second positioning hole. The first positioning pin 140*a* of the front side plate 140 fits in the first positioning hole of the casing 186 of the transmission assembly 185. The second positioning ping 140*b* of the front side plate 140 fits in the second positioning hole of the casing 186 of the transmission assembly 185. Thus, the transmission assembly 185 is positioned relative to a body of the belt cleaning device. The transmission assembly 185 is fixed on the front side plate 140 with three bolts 183*a*, 183*b*, and 183*c* in such a positioned state.

Figure 18:
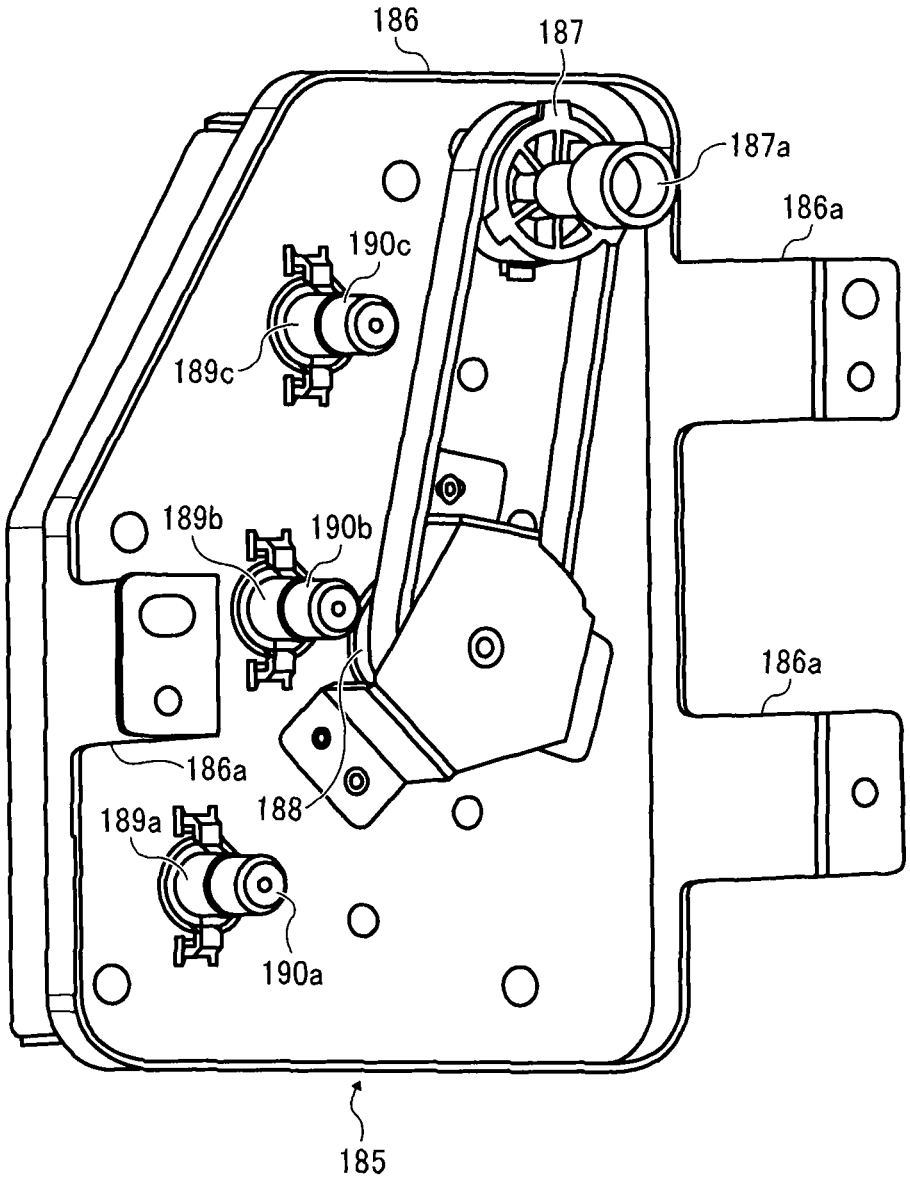
FIG. 18 is a perspective view of the transmission assembly seen from a back face side thereof.
Figure 19:
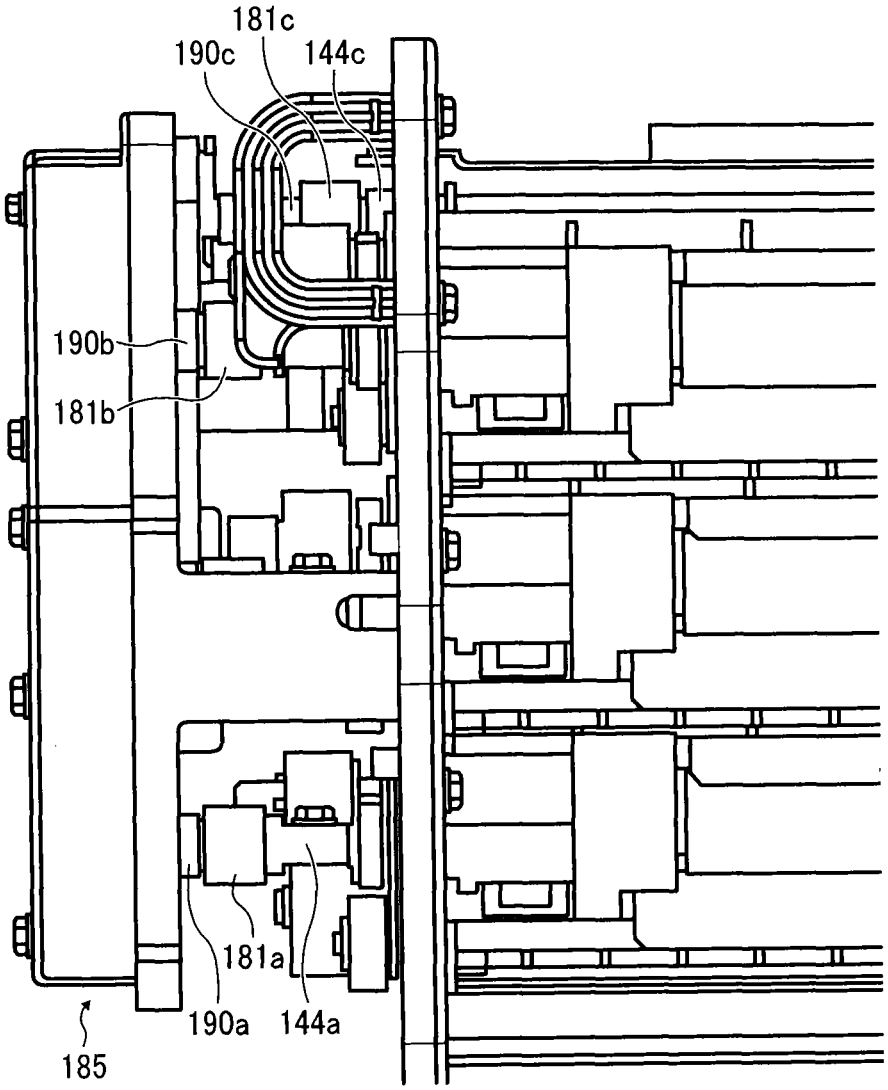
FIG. 19 is a plan view of a front edge of the belt cleaning device with the transmission assembly mounted on the front side plate, seen from a front side of the belt cleaning device.
Figure 20:
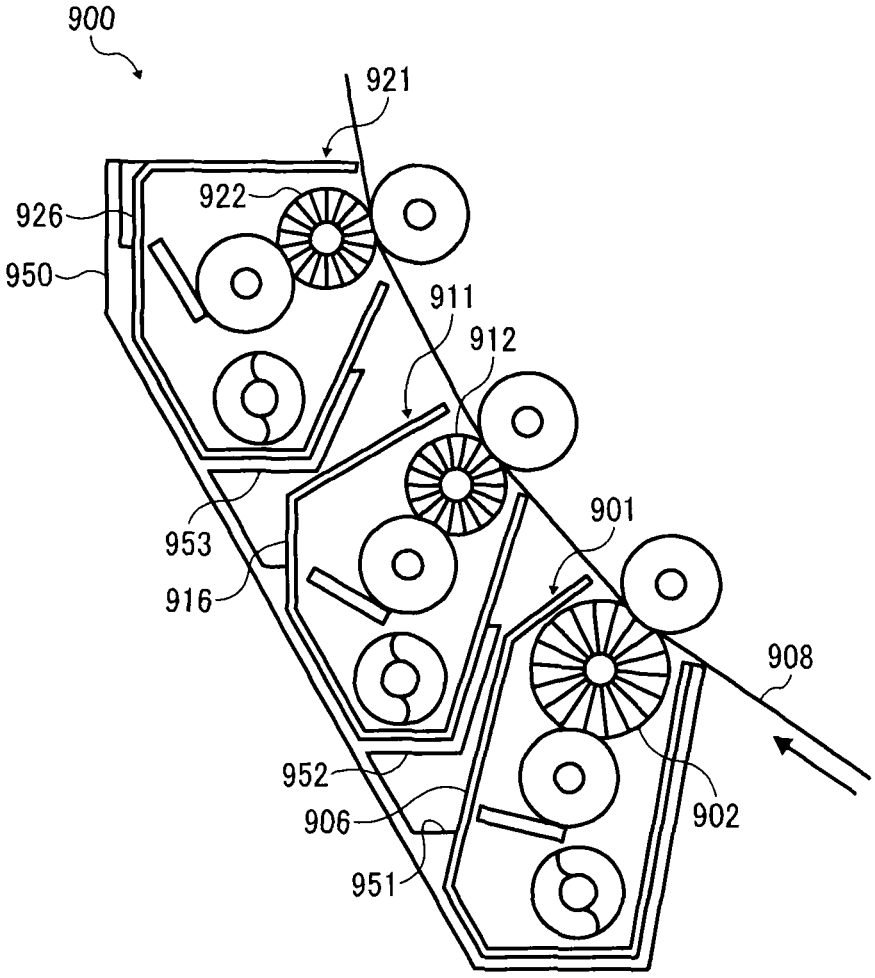
FIG. 20 RELATED ART
FIG. 20 is an enlarged view of a comparative example of a cleaning device of an image forming apparatus with an intermediate transfer belt.

FIG. 18 is a perspective view of the transmission assembly 185 seen from a back face side thereof. A back face of a casing of the transmission assembly 185 rotatably supports each of a first relay gear 187 and a second relay gear 188. An input coupling 187*a* is molded with the first relay gear 187 as a single component. When the transmission assembly 185 is mounted on the front side plate 140, the input coupling 187*a* is coupled with the output coupling (182 in FIG. 15) of the edge of the drive shaft (130 in FIG. 15) which is disposed at the body of the belt cleaning device 100. The rotation drive of the drive output shaft (192 in FIG. 14) of the belt drive assembly disposed at the transfer unit 7 is transmitted to the first relay gear 187 of the transmission assembly 185 via the drive shaft (130 in FIG. 14).

A belt is stretched over and around the first relay gear 187 and the first relay gear 187. The rotation drive of the first relay gear 187 is transmitted to the second relay gear 188. A rotary shaft of the second relay gear 188 engages one gear of a gear train including multiple gears within the casing 186 of the transmission assembly 185. The gears of the gear train include, e.g., a first output gear 189*a*, a second output gear 189*b*, and a third output gear 189*c*. The rotation drive of the second relay gear 188 is also transmitted to the first output gear 189*a*, the second output gear 189*b*, and the third output gear 189*c*. Each of the first output gear 189*a*, the second output gear 189*b*, and the third output gear 189*c* protrudes beyond the back face of the casing 186 via a through-hole of the casing 186. A drive output coupling 190*a* serving as a joint coupler is secured to a protruding portion of the first output gear 189*a* protruding beyond the casing 186 so as to rotate coaxially with the first output gear 189*a*. A drive output coupling 190*b* serving as a joint coupler is secured to a protruding portion of the second output gear 189*b* protruding beyond the casing 186 so as to rotate coaxially with the second output gear 189*b*. A drive output coupling 190*c* serving as a joint coupler is secured to a protruding portion of the third output gear 189*c* protruding beyond the casing 186 so as to rotate coaxially with the third output gear 189*c*.

When the transmission assembly 185 is mounted on the front side plate 140 of the belt cleaning device 100, the drive output coupling 190*a* of the first output gear 189*a* of the transmission assembly 185 is coaxially coupled with the drive receive coupling (181*a* in FIG. 15) of the first cleaning sub-unit 101. The drive output coupling 190*b* of the second output gear 189*b* of the transmission assembly 185 is coaxially coupled with the drive receive coupling (181*b* in FIG. 15) of the second cleaning sub-unit 111. The drive output coupling 190*c* of the third output gear 189*c* of the transmission assembly 185 is coaxially coupled with the drive receive coupling (181*c* in FIG. 15) of the third cleaning sub-unit 121. Thus, the driving force is transmitted to each cleaning sub-unit.

In FIG. 16, in removing the first cleaning sub-unit 101, the second cleaning sub-unit 111, and the third cleaning sub-unit 121, an operator performs the following operation. First, the operator unbolts the three bolts 183*a*, 183*b*, and 183*c* to remove the transmission assembly 185 from the front side plate. Then, for example, for the first cleaning sub-unit 101, the operator loosens the bolt of the first sub-unit faceplate 141*a* to remove the first sub-unit faceplate 141*a* from the front side plate 140. Thus, a sub-unit removal opening covered with the first sub-unit faceplate 141*a* is widely opened. Next, the operator puts his/her hand into the sub-unit removal opening of the front side plate 140 and pulls out the first cleaning sub-unit 101 from the sub-unit holder casing 150. In installing the first cleaning sub-unit 101 into the sub-unit holder casing, the operator performs the pull-out steps in the opposite order. In the same manner, the second cleaning sub-unit 111 or the third cleaning sub-unit 121 can be installed into and removed from the sub-unit holder casing.

In such install and removal operations, the operator is not forced to remove the belt stretched around and between the two cleaning sub-units. Accordingly, when a plurality of cleaning sub-units is installed to or removed from the sub-unit holder casing 150, the operator is not forced to attach or remove multiple belts, and it is enough to attach or remove the transmission assembly 185 relative to the sub-unit holder casing 150 only once. Such a configuration enhances work performance of the operator in install and removal of the plurality of cleaning sub-units relative to the sub-unit holder casing 150.

In this embodiment, each of the drive output coupling 190*a* to 190*c* serving as joint couplers and the drive receive couplings 181*a* to 181*c* serving as joint couplers are is made of insulating resin. Such a configuration prevents cleaning bias applied to the cleaning brush rollers 102, 112, and 122 from leaking to the outside via the couplings.

For the image forming apparatus, the transmission assembly 185 is installed or removed relative to the front side plate 140 located at an edge in a direction in which the cleaning sub-units 191, 111, and 121 are pulled out from the sub-unit holder casing 150. Such a configuration allows installation and removal of the transmission assembly 185 relative to the sub-unit holder casing 150 without removing the entire belt cleaning device 100 from the apparatus body of the image forming apparatus. Accordingly, the cleaning sub-units can be installed into and removed from the sub-unit holder casing 150 without pulling out the entire belt cleaning device 100 from the apparatus body, thus enhancing the operation performance in installation and removal.

As described above, in FIG. 18, after the first relay gear 187 receives an external rotation drive, the first relay gear 187 transmits the rotation drive to the first output gear 189*a*, the second output gear 189*b*, and the third output gear 189*c* via the second relay gear 188. The casing 186 houses a group of gears to transmit the rotation drive of the second relay gear 188 to each of the first output gear 189*a*, the second output gear 189*b*, and the third output gear 189*c*. As described above, the transmission assembly 185 accommodates the group of main gears within the casing 186.

By contrast, as illustrated in FIG. 15, the body of the belt cleaning device 100 exposes the first drive transmitter 146*a*, the second drive transmitter 146*b*, and the third drive transmitter 146*c*, which are supported with the front side plate 140, to the outside. As illustrated in FIG. 18, the transmission assembly 185 extends three legs 186*a* from a base of the casing 186 so as to be fixed at the front side plate 140 away from the first drive transmitter 146*a*, the second drive transmitter 146*b*, and the third drive transmitter 146*c*. The legs 186*a* is formed by sheet metal processing. Due to a relatively small thickness, when the legs 186*a* are removed from the front side plate 140, the legs 186*a* are likely to deform. If the legs 186*a* deform, the accuracy may decrease in positioning of the transmission assembly 185 relative to the first drive transmitter 146*a*, the second drive transmitter 146*b*, and the third drive transmitter 146*c* disposed at the body of the belt cleaning device 100. Such a reduced accuracy might hamper mounting of the transmission assembly 185 to the front side plate 140. For example, gears of the drive receive couplings (181*a* to 181*c* in FIG. 15) of the body of the belt cleaning device 100 might hit against gears of the drive output couplings (190*a* to 190*c* in FIG. 18) in the rotation axis direction. As a result, a gear teeth of one of the drive receive couplings and the drive output couplings cannot insert to spaces between gear teeth of the other of the drive receive couplings and the drive output couplings, thus preventing two couplings from engaging with each other in the rotation axial direction. Consequently, the transmission assembly 185 might not be mounted on the front side plate 140.

Figure 21:
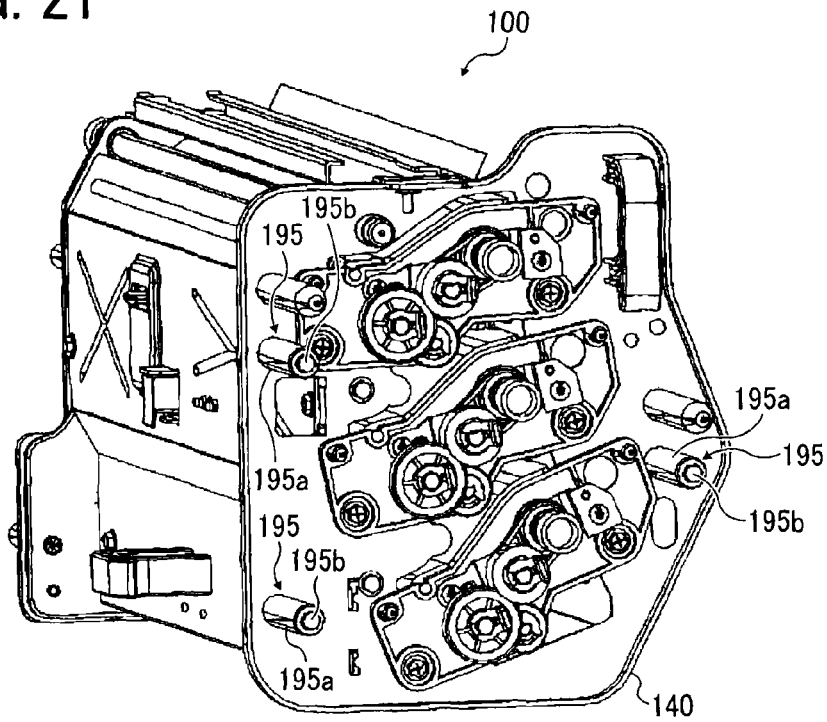
FIG. 21 is a partial perspective view of a part of a belt cleaning device in a state in which a transmission assembly is removed in an image forming apparatus according to an embodiment of this disclosure, seen from a side at which a front side plate is disposed.

Next, a configuration of an image forming apparatus according to another embodiment of this disclosure is described below. Unless specifically described, the configuration of the image forming apparatus in this embodiment is similar to, if not the same as, that of the image forming apparatus according to the above-described embodiment. FIG. 21 is a partial perspective view of a part of a belt cleaning device 100 in a state in which a transmission assembly 185 is removed in the image forming apparatus according to this embodiment, seen from a side at which a front side plate 140 is disposed. A front face of the front side plate 140 has three studs 195 serving as supports protruding in a direction in which the cleaning sub-unit is pulled out. Each of the stud 195 includes a cylindrical, hollow stud body 195*a*, a female thread, and a bolt 195*b*. The female thread is disposed in a hollow space of the stud body 195*a*. The bolt 195*b* is screwed together with the bolt 195*b*.

Figure 22:
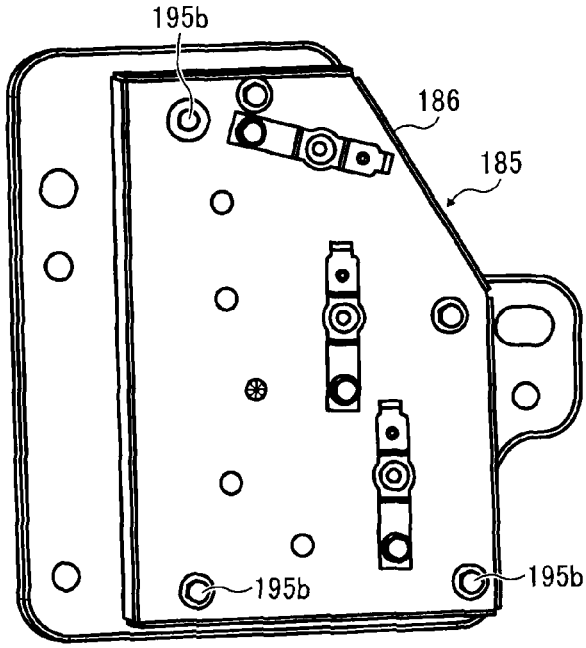
FIG. 22 is a perspective view of the transmission assembly in a state of being mounted on a body of the belt cleaning device.

FIG. 22 is a perspective view of the transmission assembly 185 in a state of being mounted on a body of the belt cleaning device 100. A front face plate of the transmission assembly 185 has three holes corresponding to the three studs 195. From an outside of the front face plate of the transmission assembly 185, the bolts 195*b* of the three studs 195 are screwed together with the female threads of the three studs 195, which are disposed at a back side of the front face plate in FIG. 22. Thus, the transmission assembly 185 is fixed at the front side plate 140 of the body of the belt cleaning device 100 with the transmission assembly 185 supported with the three studs 195.

The three studs 195 have a sturdy structure and is unlikely to deform. As compared with a configuration in which the transmission assembly 185 are supported with legs (e.g., the legs 186*a*), such a configuration suppresses a reduction in positioning accuracy between the transmission assembly 185 and the three drive transmitter 146*a* to 146*c* disposed at the body of the belt cleaning device 100. Thus, operation performance in mounting the transmission assembly 185 can be enhanced.

The length of the studs 195 is preferably set as follow. For example, the length of each of the studs 195 is preferably set to not less than a total of a distance from the front face (edge) of the front side plate 140*a* leading edge of the drive receive coupling (181*a* to 181*c*) and a distance from the back face of the transmission assembly 185 to the drive output coupling (190*a* to 190*c*). It is to be noted that a length slightly value than the total may be set as a minimum length. For example, the minimum length is a value obtained by subtracting, from the total, a depth of a recess of one of the drive receive coupling (181*a* to 181*c*) and the drive output coupling (190*a* to 190*c*) that receives the other. Accordingly, in the image forming apparatus in this embodiment, the length of each of the studs 195 is set to be greater than the value.

In consideration of dimensional errors of components, couplings are preferably configured to transmit drive even if the couplings are slightly shifted in the rotation axial direction. For the image forming apparatus according to this embodiment, for example, the length of the stud 195 is set to be greater than the above-described value by 0.4 mm.

The studs 195 are preferably three or more. The three or more studs 195 allow the transmission assembly 185 to be supported on a plane constituted of leading edges of the three or more studs 195. For the image forming apparatus according to this embodiment, as illustrated in FIG. 21, one stud 195 is disposed on a right side of the front side plate 140, another stud 195 is disposed on an upper left side of the front side plate 140, and another is disposed on a lower left side of the front side plate 140. To stably support the transmission assembly 185, at least one of the studs 195 is preferably disposed around a center of the three cleaning brush rollers arranged at the body of the belt cleaning device 100.

The studs 195 preferably have a certain degree or more of strength to stably support the transmission assembly 185 against a force generated by the driving. Therefore, the studs 195 are preferably a cylindrical stud including metal, such as iron, aluminum, and/or stainless steel, having a diameter of 5 mm or more. For the image forming apparatus according to this embodiment, the studs 195 has a cylindrical shape of a diameter of 5 mm or more and is made of free-cutting steel. A deformation amount at which the stud 195 deforms when applied with a load of 6 [N] is 0.1 mm or less.

The image forming apparatus according to this embodiment employs the studs 195 made of conductive material and applies a high voltage of X [kv] to the cleaning brush roller. The studs 195 are disposed at positions away from the cleaning brush roller by 2×X mm to prevent occurrence of electric discharge between the cleaning brush roller and each of the studs 195.

The above description is just an example, and an image forming apparatus according to embodiments of this disclosure can exert, for example, an effect in each of the following aspects.

[Aspect A]

A unit device is detachably attachable relative to a machine body. The unit device includes a plurality of sub units each including a driver to be driven by a driving force received and a sub-unit holder to hold the plurality of sub-units. The unit device further includes a detachable transmission assembly. The transmission assembly includes a driving-force receive rotator to receive a rotation driving force transmitted from an external unit and a plurality of drive transmission rotators to transmit the rotation driving force received by the driving-force receive rotator to a plurality of drive receive rotators of the plurality of sub units. Each of the plurality of the drive receive rotators and the plurality of drive transmission rotators has a joint coupler to couple each of the plurality of drive receive rotators with a corresponding one of the plurality of drive transmission rotators.

For such a configuration, first, an operator removes the transmission assembly from the sub-unit holder ahead of removal of the plurality of sub units from the sub-unit holder. As a result, joint couplers of the drive receive rotators of the plurality of sub units are decoupled from joint couplers of the drive transmission rotators disposed at the transmission assembly so as to correspond to the drive receive rotators. Thus, the sub units become separately removable from the sub-unit holder, and the operator can remove a desired one of the sub units from the sub-unit holder. To install the sub unit to the sub-unit holder, the operator the above-described steps in the opposite order. In such install and removal operations, the operator is not forced to attach or remove the belt stretched around and between the two sub cleaning units. Accordingly, when a plurality of cleaning sub-units is installed to or removed from the sub-unit holder, the operator is not forced to attach or remove multiple belts, and it is enough to attach or remove the transmission assembly relative to the sub-unit holder only once. Such a configuration enhances work performance of the operator in install and removal of the plurality of sub-units relative to the sub-unit holder.

[Aspect B]

According to Aspect B, a cleaning device (e.g., the belt cleaning device 100) includes a cleaner (e.g., cleaning brush rollers 102, 112, 122) to scrape off adhered material from a surface of a cleaning target (e.g., intermediate transfer belt 8); a plurality of cleaning sub-units (e.g., cleaning sub-units 101, 111, 121) each including a holder (e.g., sub-unit casings 106, 116, 126) to hold the cleaner and a drive-receive rotator to receive a driving force; a sub-unit holder (e.g., sub-unit holder casing 150) holding the plurality of cleaning sub-units; a detachable transmission assembly (e.g., transmission assembly 185) including a driving-force receive rotator (e.g., first relay gear 187) to receive a driving force from an external unit and a plurality of drive transmission rotators (e.g., output gears 189*a* to 189*c*) to transmit the driving force received by the driving-force receive rotator to the drive-receive rotators of the plurality of cleaning sub-units; and a plurality of joint couplers (e.g., drive output couplings 190*a* to 190*c* and drive receive couplings 181*a* to 181*c*) mounted on the drive-receive rotators and the plurality of drive transmission rotators to couple the drive-receive rotators with the plurality of drive transmission rotators in a rotation axial direction.

Such a configuration enhances work performance of an operator in install and removal of the plurality of cleaning sub-units relative to the body of the belt cleaning device 100.

[Aspect C]

According to Aspect C, in the cleaning device according to Aspect B, the transmission assembly is detachably attachable relative to a body of the cleaning device in the rotational axial direction. Thus, when the transmission assembly is moved in the rotational axial direction and installed to or removed from the sub-unit holder, joint couplers of the drive-receive rotators of the plurality of cleaning sub-units are automatically coupled with or decoupled from joint couplers of the plurality of drive transmission rotators in the transmission assembly.

[Aspect D]

According to Aspect D, in the cleaning device according to Aspect B or C, the plurality of joint couplers is made of insulating material. Such a configuration prevents cleaning bias applied to the cleaner from leaking to the outside via the joint couplers.

[Aspect E]

According to Aspect E, in the cleaning device according to any one of Aspects B to D, the transmission assembly is detachably attachable relative to a body of the cleaning device in the rotational axial direction. For such a configuration, as described in the embodiments of this disclosure, the plurality of cleaning sub-units can be installed into and removed from the sub-unit holder without pulling out the entire belt cleaning device from a body of an image forming apparatus, thus enhancing the operation performance in installation and removal.

[Aspect F]

According to Aspect F, in the cleaning device according to Aspect E, the belt cleaning device has a support (e.g., studs 195) protruding from a surface of the edge of the body (e.g., the front side plate 140) of the belt cleaning device in the direction in which the plurality of cleaning sub-units is pulled out from the sub-unit holder, and the transmission assembly is fixed on the support. As described above, such a configuration can enhance operation performance of an operation in installing the transmission assembly as compared with a configuration in which the transmission assembly is supported with legs of sheet metal.

[Aspect G]

According to Aspect G, in the cleaning device according to Aspect F, a height of the support is greater than a value obtained by subtracting a total of a length from a depth of a recess of one of the plurality of joint couplers to receive another of the plurality of joint couplers from a total of a length from the surface of the edge to a leading edge of the one of the plurality of joint couplers mounted to the drive-receive rotators in the direction and a length from a back face of a body of the transmission assembly to a leading edge of the plurality of drive transmission rotators in the direction. For such a configuration, as described above, the drive receive rotators and the drive transmission rotators can be placed within the length of the support, thus allowing the transmission assembly to be reliably mounted to the body of the belt cleaning device.

[Aspect H]

According to Aspect H, the cleaning device according to Aspect F or G includes three or more joint couplers as the plurality of joint couplers. For such a configuration, as described above, the transmission assembly can be stably supported with protruding edges of the three or more supports.

[Aspect I]

According to Aspect I, in the cleaning device according to any one of Aspects F to H, the support has a cylindrical shape having a diameter of 5 mm or greater and is made of free-cutting steel. Such a configuration effectively suppresses deformation of the support.

[Aspect J]

According to Aspect J, an image forming apparatus includes an image bearer to bear a toner image; an image forming device to form a toner image on a surface of the image bearer; and the cleaning device according to any one of Aspects B to I to scrape off toner as adhered substance on the surface of the image bearer.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A cleaning device, comprising:

a cleaner to scrape off adhered material from a surface of a cleaning target while contacting the surface of the cleaning target;

a plurality of cleaning sub-units each including a holder to hold the cleaner and a drive-receive rotator to receive a driving force;

a sub-unit holder holding the plurality of cleaning sub-units;

a detachable transmission assembly including a driving-force receive rotator to receive a driving force from an external unit and a plurality of drive transmission rotators to transmit the driving force received by the driving-force receive rotator to the drive-receive rotators of the plurality of cleaning sub-units; and a plurality of joint couplers mounted on the drive-receive rotators and the plurality of drive transmission rotators to couple the drive-receive rotators with the plurality of drive transmission rotators in a rotation axial direction, wherein the transmission assembly is detachably attached to an edge of a body of the cleaning device in a direction in which the plurality of cleaning sub-units is pulled out from the sub-unit holder, wherein the cleaning device further comprises a support protruding from a surface of the edge of the body in the direction in which the plurality of cleaning sub-units is pulled out from the sub-unit holder, and wherein the transmission assembly is fixed on the support.

2. The cleaning device according to claim 1, wherein the transmission assembly is detachably attachable relative to a body of the cleaning device in the rotational axial direction.

3. The cleaning device according to claim 1, wherein the plurality of joint couplers is made of insulating material.

4. The cleaning device according to claim 1, wherein a height of the support is greater than a value obtained by subtracting a depth of a recess of one of the plurality of joint couplers to receive another of the plurality of joint couplers from a total of a length from the surface of the edge to a leading edge of the one of the plurality of joint couplers mounted to the drive-receive rotators in the direction and a length from a back face of a body of the transmission assembly to a leading edge of the plurality of drive transmission rotators in the direction.

5. The cleaning device according to claim 1, wherein the support includes at least three supports.

6. The cleaning device according to claim 1, wherein the support has a cylindrical shape having a diameter of 5 mm or greater.

7. The cleaning device according to claim 1, wherein the support includes free cutting steel.

8. An image forming apparatus, comprising:

an image bearer to bear a toner image;

an image forming device to form a toner image on a surface of the image bearer; and a cleaning device including a cleaner to scrape off toner as adhered substance from the surface of the image bearer, a plurality of cleaning sub-units each including a holder to hold the cleaner and a drive-receive rotator to receive a driving force, a sub-unit holder holding the plurality of cleaning sub-units, a detachable transmission assembly including a driving-force receive rotator to receive a driving force from an external unit and a plurality of drive transmission rotators to transmit the driving force received by the driving-force receive rotator to the drive-receive rotators of the plurality of cleaning sub-units, and a plurality of joint couplers mounted on the drive-receive rotators and the plurality of drive transmission rotators to couple the drive-receive rotators with the plurality of drive transmission rotators in a rotation axial direction, wherein the transmission assembly is detachably attached to an edge of a body of the cleaning device in a direction in which the plurality of cleaning sub-units is pulled out from the sub-unit holder, and wherein the cleaner further comprises a support protruding from a surface of the edge of the body in the direction in which the plurality of cleaning sub-units is pulled out from the sub-unit holder, and wherein the transmission assembly is fixed on the support.

* * * * *